US012127672B2

(12) United States Patent
Hammond

(10) Patent No.: US 12,127,672 B2
(45) Date of Patent: Oct. 29, 2024

(54) REPOSITIONAL STORAGE SHELF

(71) Applicant: Shari Michelle Hammond, Georgetown, TX (US)

(72) Inventor: Shari Michelle Hammond, Georgetown, TX (US)

(73) Assignee: Aacraft, Inc., Georgetown, TX (US)

( * ) Notice: Subject to any disclaimer, the term of this patent is extended or adjusted under 35 U.S.C. 154(b) by 232 days.

(21) Appl. No.: 17/532,037

(22) Filed: Nov. 22, 2021

(65) Prior Publication Data

US 2022/0079341 A1 Mar. 17, 2022

Related U.S. Application Data

(63) Continuation of application No. 29/657,312, filed on Jul. 20, 2018, now abandoned.

(60) Provisional application No. 63/256,580, filed on Oct. 17, 2021.

(51) Int. Cl.

| | |
|---|---|
| ***A47B 88/48*** | (2017.01) |
| ***A47B 88/969*** | (2017.01) |
| *A47B 46/00* | (2006.01) |
| *A47B 47/00* | (2006.01) |
| *A47B 49/00* | (2006.01) |
| *A47B 57/00* | (2006.01) |
| *A47B 63/06* | (2006.01) |
| *A47B 65/00* | (2006.01) |

(52) U.S. Cl.

CPC ..... *A47B 88/48* (2017.01); *A47B 88/969* (2017.01); *A47B 46/00* (2013.01); *A47B 47/0091* (2013.01); *A47B 49/00* (2013.01); *A47B 57/00* (2013.01); *A47B 63/062* (2013.01); *A47B 65/10* (2014.12)

(58) Field of Classification Search

CPC ..... A47B 88/48; A47B 88/969; A47B 88/40; A47B 88/42; A47B 46/00; A47B 47/0091; A47B 47/047; A47B 49/00; A47B 57/00; A47B 57/06; A47B 57/16; A47B 57/20; A47B 57/30; A47B 57/48; A47B 2063/005; A47B 63/00; A47B 63/06; A47B 63/062; A47B 65/00; A47B 65/10; A47B 77/00

See application file for complete search history.

(56) References Cited

U.S. PATENT DOCUMENTS

| | | | | | |
|---|---|---|---|---|---|
| 827,649 | A * | 7/1906 | Murphy | A47B 63/02 211/74 |
| 2,679,341 | A * | 5/1954 | Tinker | D05B 91/14 D3/25 |
| 2,840,438 | A * | 6/1958 | Sharpe | F25D 25/027 211/144 |
| 4,140,223 | A * | 2/1979 | Rau | A47F 3/10 D7/600 |
| D253,154 | S * | 10/1979 | Kriesten | D7/637 |
| 4,714,305 | A * | 12/1987 | Service | A47B 88/41 211/74 |
| 4,984,854 | A * | 1/1991 | DeLavallade | A47F 3/08 312/330.1 |

(Continued)

*Primary Examiner* — Devin K Barnett

(74) *Attorney, Agent, or Firm* — G. Michael Roebuck; THE MOSTER LAW FIRM

(57) ABSTRACT

A storage system, the system is disclosed having a base; a slot in the base; a spline that slides along the base; a plurality of latches in the spline; a plurality of shelves snapped into the plurality of latches; a cam attached to a bottom of the spline, wherein the cam is slidably inserted into the slot in the base and guides spline along a path along the base.

12 Claims, 27 Drawing Sheets

Scale 1:2

Bottom

Scale 2:3

(56) References Cited

U.S. PATENT DOCUMENTS

| | | | | | |
|---|---|---|---|---|---|
| D380,357 | S * | 7/1997 | Kibbe | D7/600.4 | |
| 5,669,683 | A * | 9/1997 | Moss | A47B 47/06 312/259 | |
| 6,382,433 | B1 * | 5/2002 | Podergois | A47F 5/10 211/195 | |
| 7,044,312 | B2 * | 5/2006 | Yang | A47B 57/40 211/187 | |
| 7,237,686 | B2 * | 7/2007 | Bertrand | A47B 73/00 211/74 | |
| 7,832,816 | B2 * | 11/2010 | Compagnucci | A47B 88/42 312/322 | |
| D652,684 | S * | 1/2012 | Herrera | D7/600.1 | |
| D828,051 | S * | 9/2018 | Tang | D6/672 | |
| 11,154,145 | B1 * | 10/2021 | Pfeifer | A47B 43/02 | |
| 11,832,741 | B2 * | 12/2023 | Burgert | A47F 5/116 | |
| D1,011,103 | S * | 1/2024 | Hammond | D6/675.1 | |
| 2004/0232810 | A1 * | 11/2004 | Kreyenkamp | A47B 88/48 312/322 | |
| 2005/0274684 | A1 * | 12/2005 | Swanson | A47B 49/00 211/78 | |
| 2007/0170132 | A1 * | 7/2007 | Bertrand | A47J 47/16 211/70.6 | |
| 2012/0298604 | A1 * | 11/2012 | Fuhrer | A47B 77/16 211/163 | |

* cited by examiner

Scale 1:2

Scale 1:2

Bottom FIG. 3

Scale 2:3

Front FIG. 4

Scale 2:3

Scale 2:3

Top FIG. 6

Scale 2:3

Top - shell only

Scale 2:3

Left

Scale 2:3

Front - shelf only

Scale 2:1

Shelf snap - engaged

Scale 5:1

Shelf snap - rotate and pull to disengage

Scale 5:1

Rotate shelf to access items on shelf below

Scale 1:2

Scale 1:1 isometric view from top right front corner.

Top

Bottom

Re-positionable shelf.
Top View

Re-positionable shelf.
Left-Side View

Re-positionable shelf.
Right-Side View

Left

REPOSITIONAL STORAGE SHELF

CROSS REFERENCE TO RELATED APPLICATIONS

This patent application claims priority from U.S. Provisional Patent Application Ser. No. 63/256,580 filed on 17 Oct. 2021 by Shari Hammond and entitled "A Repositional Storage Shelf" which is hereby incorporated by reference in its entirety. This patent application also claims priority from U.S. Design patent application Ser. No. 29/657,312 filed on Jul. 20, 2018 by Shari Hammond and entitled "Modular Storage Rack" which is hereby incorporated by reference in its entirety.

BACK GROUND OF THE INVENTION

Storage space on shelve is limited. Access to items in a crowded storage space makes items inaccessible and hard to find. In US patent (U.S. Pat. No. 5,671,987), (US Patent Publication 2012/0217214 AI), (US Patent Publication 2007/0170132 AI), and (US Patent Publication 2005/0247843 AI) a spice container storage system is claimed but each of the above designs have only two positions; a storage position and an access position. A third rotation position is missing, limiting visualization, and requiring access from the side. In US Patent Publication 2004/0232810 AI a container storage system is claimed with three positions; a storage position, an intermittent pullout position and a 90 degree pivotal position for easy access. This design uses a vertical stacking method which is more practical for large built-in cabinets. In U.S. Pat. No. 9,211,009 B2 a plurality of spice drawers are stacked vertically, pulled out individually then rotated down about 45 degrees. This product is similar to the disclosed unit except the storage position is a horizontal drawer instead of a vertical book-like storage unit. In US Patent Publication 2012/0298604 AI a storage design is shown that is similar to the new storage system, but it has significant design shortcomings. The most serious one being that when adding additional units, approximately 1.75 inch extra space is needed on both sides separating the original storage apparatus from any add-on units. The reason this space is required is that when a selected rack is pulled out and then rotated, the back corner of the selected rack sweeps a wide area which interferes with anything close to the selected unit. Therefore, a band of wasted space is required between each storage module. Another problem with the storage rack of US 2012/0298604 AI is the design is flimsy. It primarily uses large flat thin rectangular shapes in its construction which makes the finished product very flimsy.

FIELD OF THE INVENTION

The present invention relates to a modular storage space for kitchen cabinets.

SUMMARY OF THE INVENTION

In a particular illustrative embodiment of the invention, a modular storage shelf with repositionable shelves is disclosed.

BRIEF DESCRIPTION OF THE DRAWINGS

The drawings presented herein are for illustrative purposes only and do not limit the scope of the claims. Rather, the drawings are intended to help enable one having ordinary skill in the art to make and use the claimed inventions.

DETAILED DESCRIPTION OF AN ILLUSTRATIVE EMBODIMENT OF THE INVENTION

Figure 1:
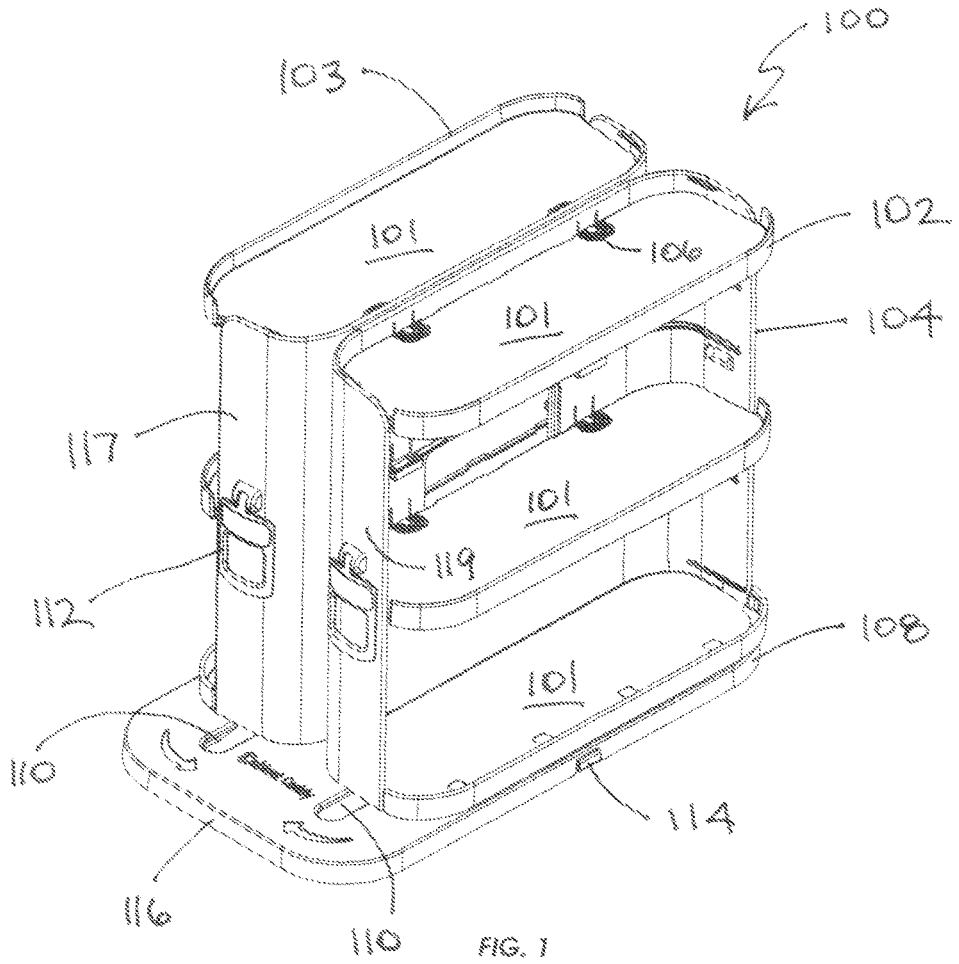
FIG. 1 is a depiction of a three quarter prospective view of a particular illustrative embodiment of the invention.

A detailed description will now be provided. The purpose of this detailed description, which includes the drawings, is to satisfy the statutory requirements of 35 U.S.C. § 112. For example, the detailed description includes a description of inventions defined by the claims and sufficient information that would enable a person having ordinary skill in the art to make and use the inventions. In the figures, like elements are generally indicated by like reference numerals regardless of the view or figure in which the elements appear. The figures are intended to assist the description and to provide a visual representation of certain aspects of the subject matter described herein. The figures are not all necessarily drawn to scale, nor do they show all the structural details, nor do they limit the scope of the claims.

A particular illustrative embodiment of the invention is disclosed as a storage rack designed to fit inside a standard cabinet or on top of a conventional bookshelf. Each storage rack assembly contains two pullout drawers referred to herein as splines, one on the right and another on the left. Either individual spline can be pulled out of the shelf and rotated 90 degrees for ease of viewing the contents. A common item needing to be stored is a spice bottle because the number of different spice selections are numerous. Since the spice bottles vary greatly in content and bottle size, in a particular illustrative embodiment of the invention, a repositionable storage rack with maximum flexibility in shelf spacing is provided. The disclosed storage rack has multiple snap-in shelves at different levels and distance intervals between shelves for maximizing the number of bottles that can be stored.

To remove a stored bottle from the storage rack, it is provided with a convenient design wherein a user places a finger on top of a selected bottle and rotate it forward off of a rack shelf and out of the storage rack. To aid in rotating the selected bottle out and off a shelf, a shelf directly above the shelf holding a desired bottle is free to rotate upward 15 degrees and out of the way thereby providing added clearance for the selected bottle to be rotated forward and removed from the storage rack shelf. This shelf above the bottle is also easily lifted and rotated upward 15 degrees when returning a bottle to its stored position on the shelf from whence it came. To completely remove a shelf from the storage frame the shelf latch is rotate beyond the 15 degree load/unloading position to approximately 30 degrees where it is designed to snap out of the storage frame completely releasing it from the storage frame. The released shelf can be moved to a new position and snapped onto a new position or left out entirely.

In a particular illustrative embodiment of the invention, a system disclosed having a full radii on the front and back corners which allows the 90 degree rotation from the intermediate position to the retrieval station without the storage rack touching any adjacent storage rack. Since the storage racks are modular units, additional storage racks can be added and placed side by side with no lost space between the storage racks. The side by side storage racks are magnetically coupled to one another using magnets on each of the left and right sides or each storage rack. In a particular illustrative embodiment of the invention, this new and improved design allows full placement of units on a shelf giving more efficient storage and a neat library-bookrack appearance. In a particular illustrative embodiment of the invention, a disclosed design has large full radius spine on both ends of the racks giving rigidity to the unit while projecting a soft book-like appearance to the extended storage system.

FIG. 1 is a depiction of a three quarter prospective view of a particular illustrative embodiment of the invention 100. Turning now to FIG. 1, FIG. 1 depicts shows a prospective view of a particular illustrative embodiment of the invention showing a modular, organizational storage unit 100 having a left spline 117 and a right spline 119 in the home or stored position. Each spline receives shelves 101 that are snapped into slots in the splines at 106, described in more detail below. The splines rest on a base 108 and are slidably engaged with and connected to slots 110 formed in the base 108. FIG. 1 shows repositionable (movable) shelf 101 snapped into three different positions. Three is the number of shelves typically included with each product, but the splines are configured to engage up to 10 shelves, 5 shelves snapped into each of the left and right splines, when desired. All of the ten possible movable shelves 101 are identical. In a particular illustrative embodiment of the invention, although similar in appearance to the adjustable shelves, the bottom two shelves 101 are part of the storage units structural frame and cannot be moved.)

FIG. 1, shows a prospective view of modular, book-like organizational storage unit 100 in the home or stored position. Storage unit includes but is not limited to a of a bottom shelf, middle shelf and top shelf supported by right spine 119 and left spine 117. Storage unit 100 has a base 118 and is guided by cam 204 (shown in FIG. 16) which fixedly attached to pin 203 and rides in slot 110. Base 118 is supported on the cabinet floor by four high-friction feet 205 (shown in FIG. 3). Guide slot 110 has front slot end 120 and rear slot end 121 which combined with cam 204 on pin 202 guide the travel of spline 119 from the stored position in FIG. 1 to the intermediate selected position in FIG. 17.

Figure 2:
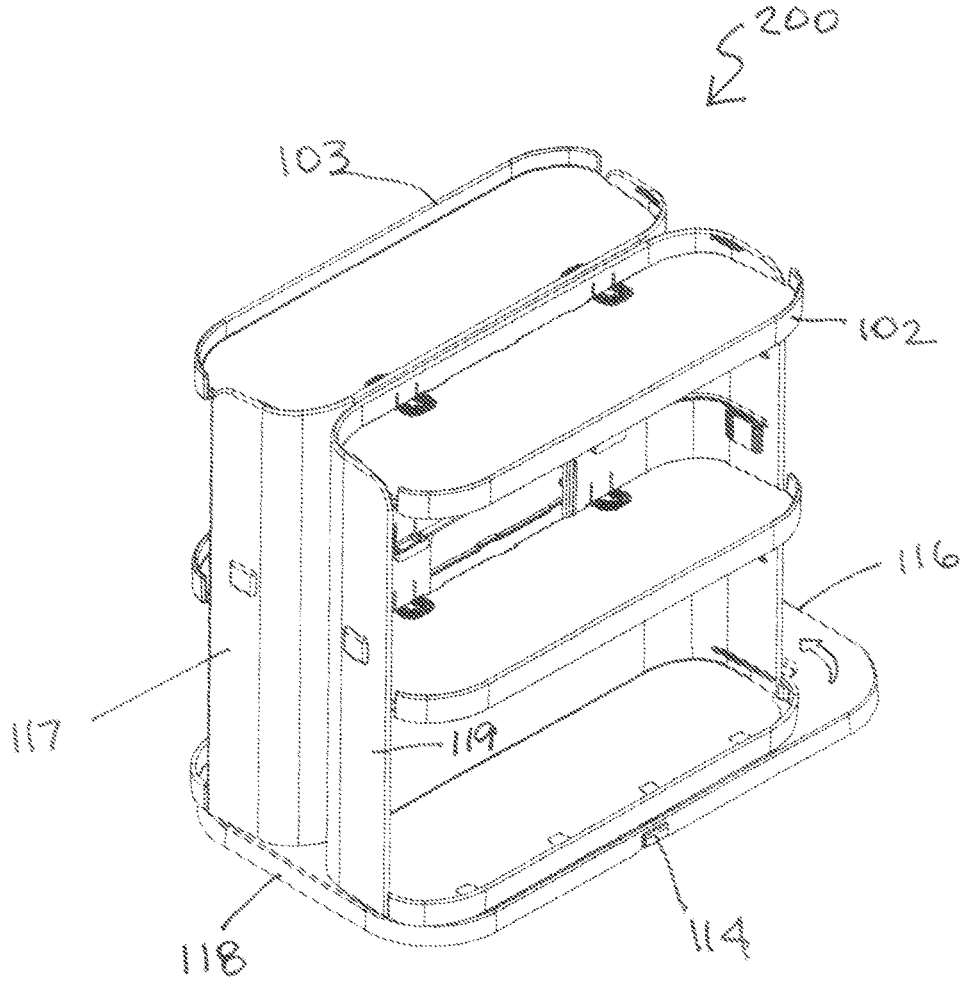
FIG. 2 is a depiction of a three quarter prospective view of a particular illustrative embodiment of the invention.
Figure 3:
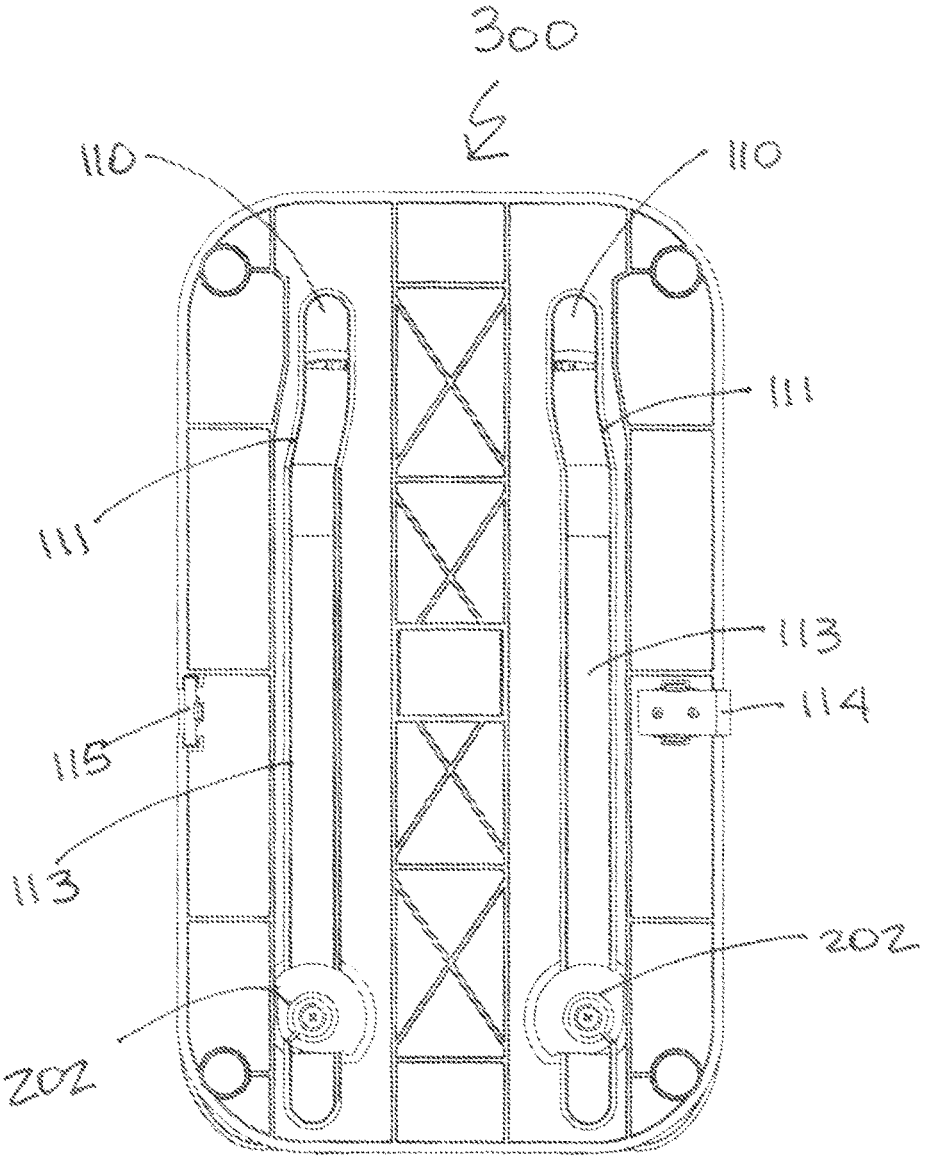
FIG. 3 is a depiction of a bottom view of a particular illustrative embodiment of the invention.

FIG. 2 is a depiction of a three quarter prospective rear view of a particular illustrative embodiment 200 of the invention. FIG. 3 is a depiction of a bottom view of a particular illustrative embodiment of the invention. FIG. 3 is a bottom view of the repositionable storage unit (1) showing how base 116 is attached to storage unit (1). FIG. 3 is a bottom view of storage unit 1 that shows a drive pin 202 fixedly attached to the bottom of storage unit (1). Drive pin 202 has two flats 207 and that rigidly attach drive pin 202 to cam 204. Screw 203 retains attached cam 204.

Turning now to FIG. 3, FIG. 3 shows how controlled sliding of the left and right spindle in base slot 110 between rear slot end 121 and front slot end 120 in a particular illustrative embodiment of the invention 300. The slot 110 has a long parallel portion 113 and a shorter parallel portion 110 connected by angled portion 111 that changes the axis of rotation of the spindle rotating in the slot for the spindle traveling from the rear end of the slot 121 to the front end of the slot 120. The axis of rotation is moved closer to the center of the bottom of system. The axis of rotation is moved closer to the center of the base at the front end 120 to enable easy rotation of a spindle when multiple repositionable storage units are connected side by side. While going from stored position in FIG. 1 to approaching the intermediate position shown in FIG. 13, rib 133 guides the spindle 1 allowing translation of the spindle but not rotation until the spindle travels on the slot past the rib 133, to further control this undesired rotation of unit 1 between the stored position and the intermediate position.

FIG. 3 shows cam 204 riding in track 110, limiting CW rotation of the spindle attached to the cam. Rib 133 is still limiting CCW rotation of spindle, so it is rotationally restrained until it gets to the intermediate position at the front end 120 of slot 110. At this point, rib 133 no longer limits rotation but cam 204 still limits CW rotation. For example, while pulling the spindle out to the intermediate position, cam 205 will not rotate until drive pin 202 reaches slot front end 120. This allows the "soft" action of the selected storage unit through the intermediate pull-out position and on to the storage access position. FIG. 3 shows a bottom view of the storage shelf and its drive pin 202, cam 204 and connecting screw 203.

Figure 16:
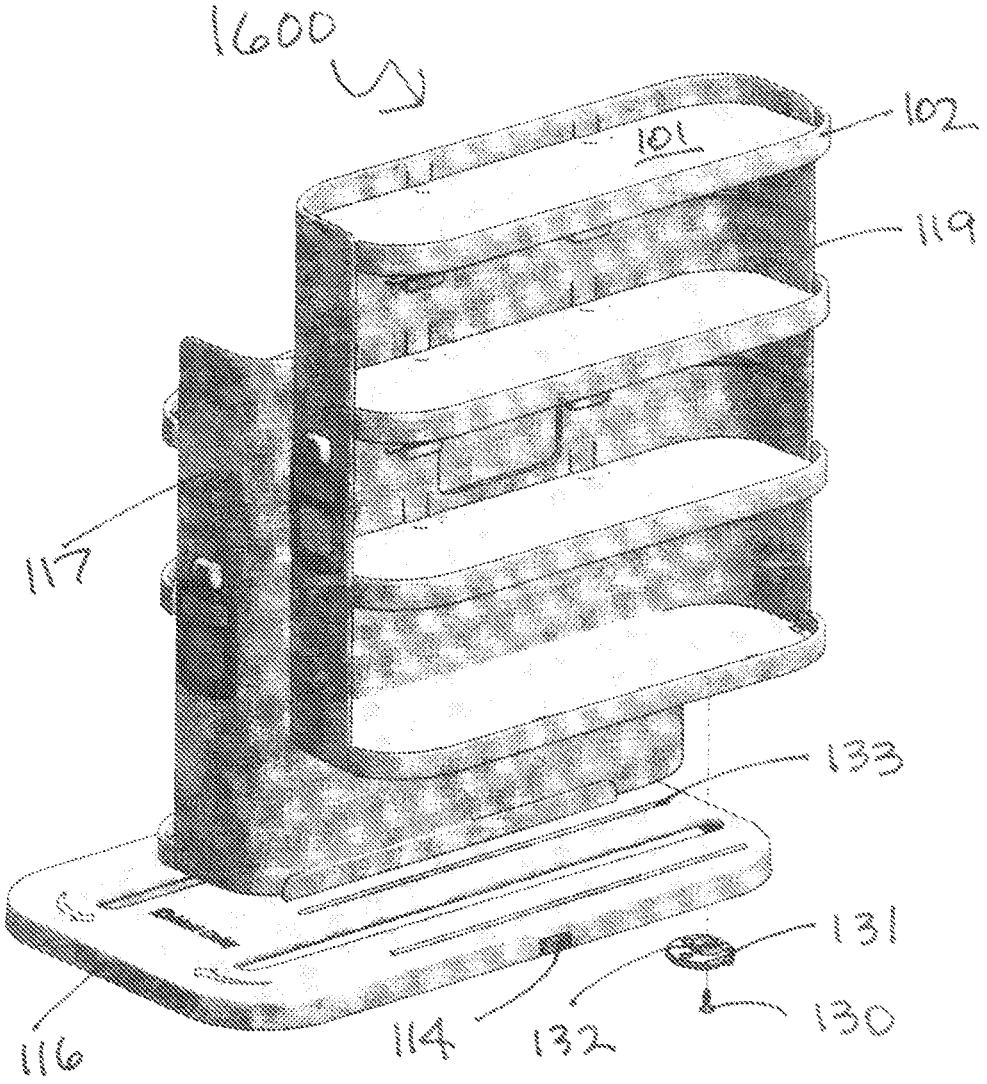
FIG. 16 is a depiction of an exploded view of a particular illustrative embodiment of the invention.
Figure 18:
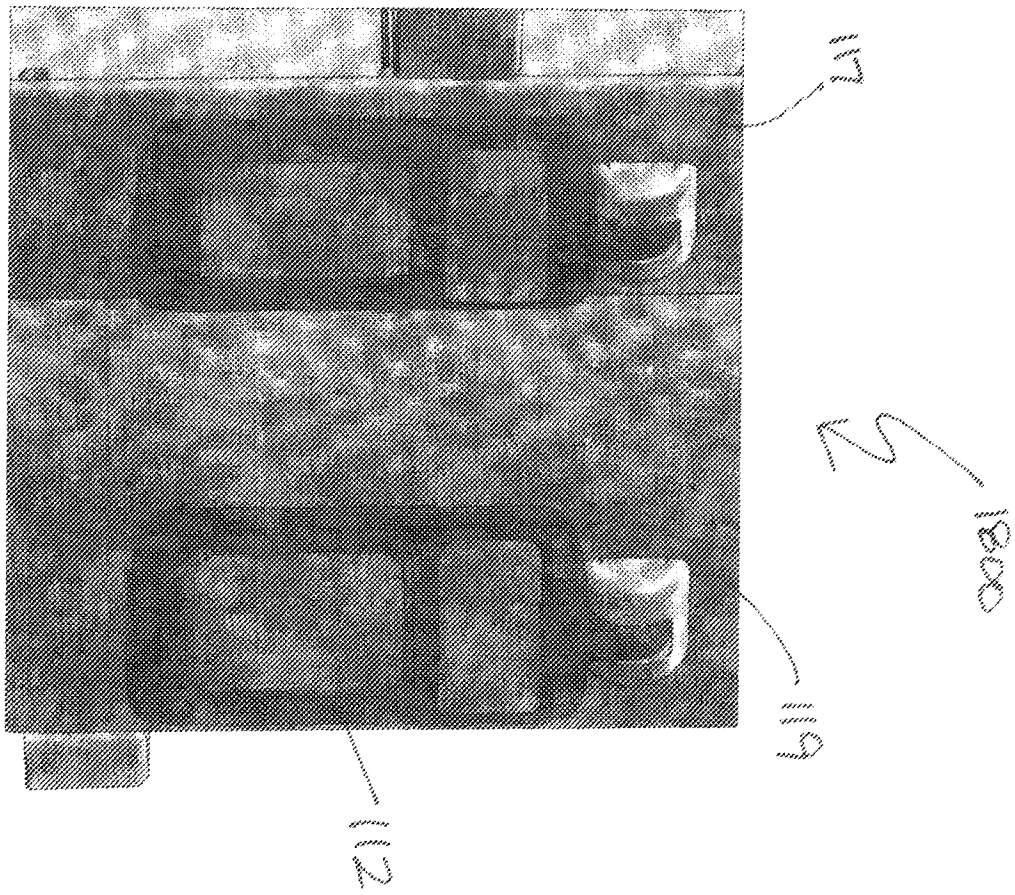
FIG. 18 is a depiction of a perspective front view of a particular illustrative embodiment of the invention.
Figure 19:
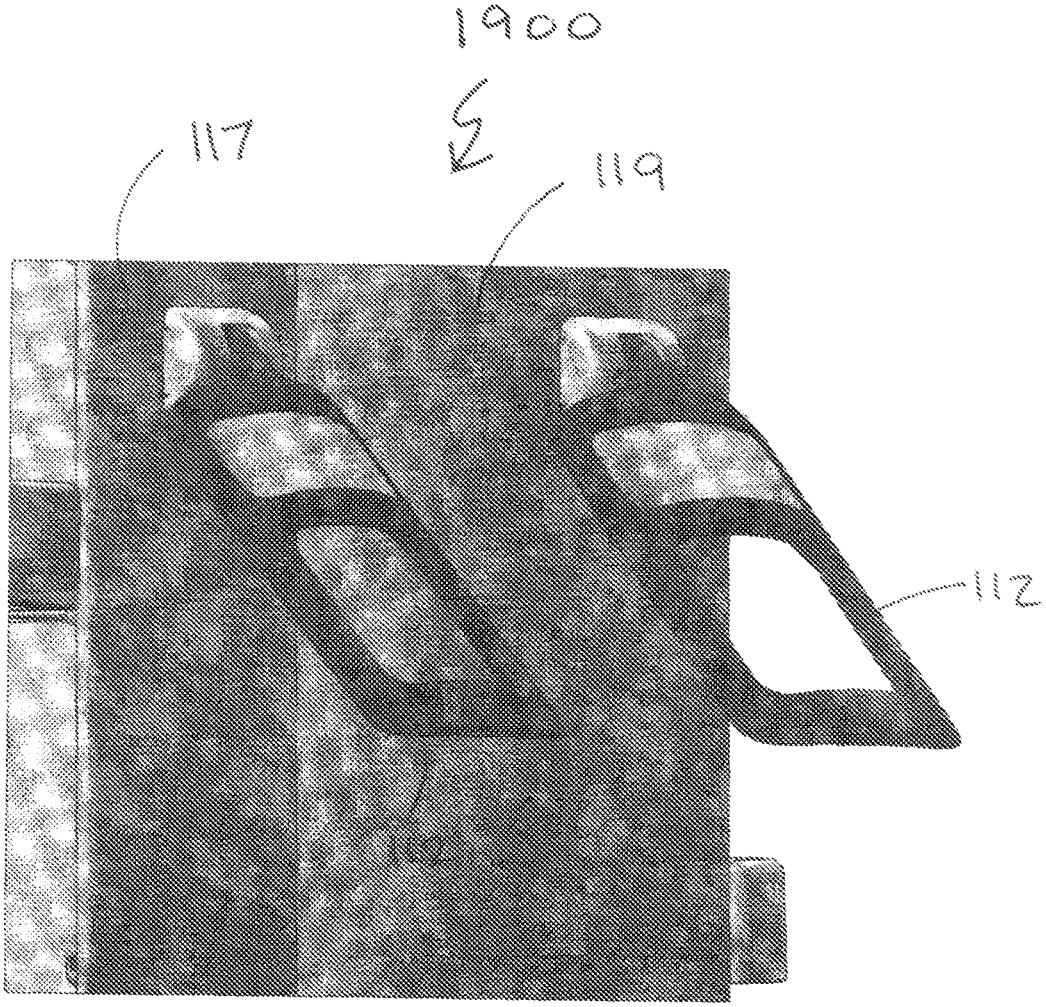
FIG. 19 is a depiction of a prospective front view of a particular illustrative embodiment of the invention.
Figure 20:
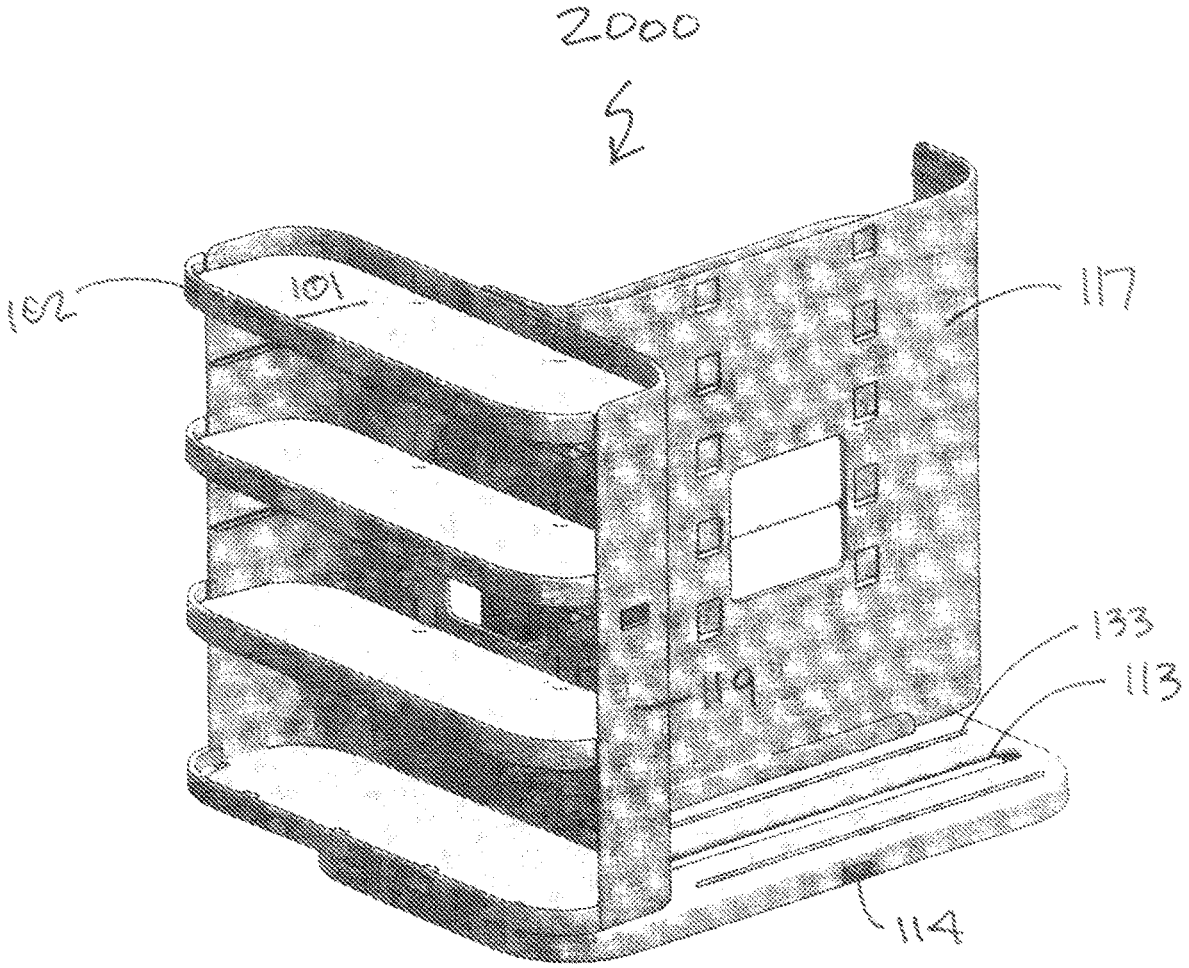
FIG. 20 is a depiction of three quarter prospective view of a particular illustrative embodiment of the invention in a third, rotated position.
Figure 21:
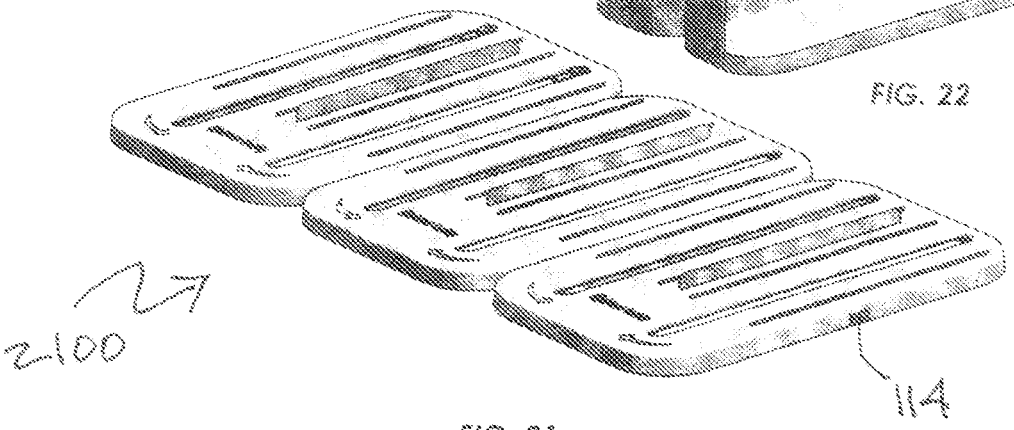
FIG. 21 is a depiction of three quarter prospective view of a particular illustrative embodiment of the invention wherein multiple storage rack system bases are joined together.

In a particular illustrative embodiment of the invention the modular concept of book-like organizational storage unit, a repositionable storage spindle and shelves allows the user to add units to fill existing shelf or cabinet space. Exploded view 1600 in FIG. 16 shows a U-shaped clip 114 that rigidly fastens adjacent bases 116 together at slot 115. FIG. 21 shows three bases 116, held together by clips. FIG. 18 1800 and FIG. 19 1900 show a drawer pull 112 that pivots at socket 170. It has an index tab 5 for cataloging the storage contents. FIG. 20 shows storage unit 1 in the storage retrieval position wherein items can be stored and retrieved from storage shelves 101. Base 116 with guiding slot 110 guides cam 204 and spindle rotating back through the intermediate position and into the stored position.

Figure 9:
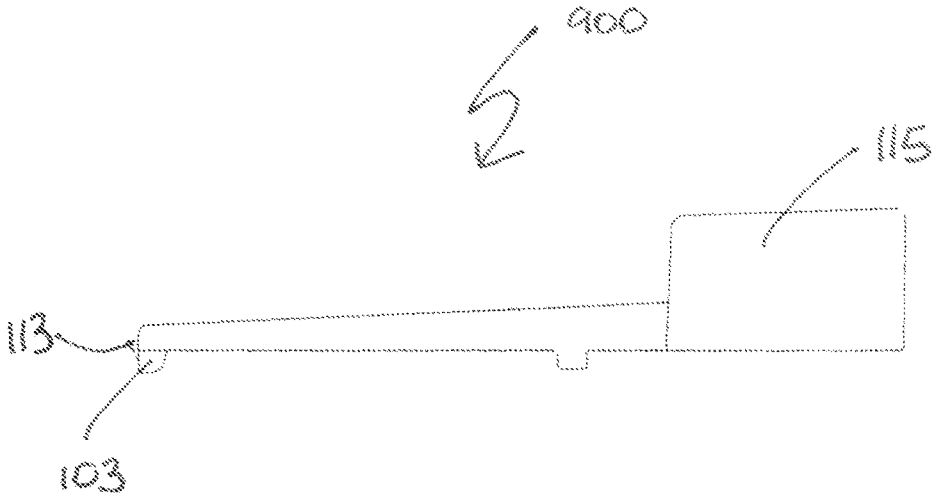
FIG. 9 is a depiction of a front view of a shelf in a particular illustrative embodiment of the invention.

The disclosed repositionable storage system can hold up to 10 installed shelves. All the shelves are identical and can be installed in any order. FIG. 9 shows a side view of one of the shelves 900. A retaining ledge 102 runs around the front of each shelf for retaining stored objects. To load a shelf 101 keep the shelf horizontal and lower it down until the shelf bottom rests on the ledge 105 and latch member 103 fits into the latch opening displacing latch spring 107 as latch member 103 slide over latch ledge 105. Latch member 113 fits under latch spring 107, securing the shelf into the latch.

As shown in FIG. 10 1000 and FIG. 11 1100, empty shelves can be removed by aggressively pulling up and out on the front of the selected shelf until it pops its latches and releases the shelf. Shelf latches are designed to repeatedly release and reset without latch damage. To install a shelf, select an empty slot position, hold the selected shelf level, and place it gently on top of the slot position ribs. A user should hear reassuring audible latch snaps. The shelf is now secured in position and the shelf is ready to load.

FIG. 7 700, FIG. 9 900, FIG. 14 1400 and FIG. 15 1500 show a side view of shelf 101 disconnected from storage unit 100. Molded depressions 106 position mark (shown in FIG. 1) where the shelf is depressed to latch shelf 101. A steady downward push at position 106 will produce a loud audible click ensures that the shelf is properly latched in position into latch 106 depressing leaf spring 107. Each tray has two identical latches that deflect molded leaf springs. From this home or latched position the floor of the shelf biases the shelf floor by 3 degrees above horizontal. This helps the stability of the bottles on the shelf.

Figure 4:
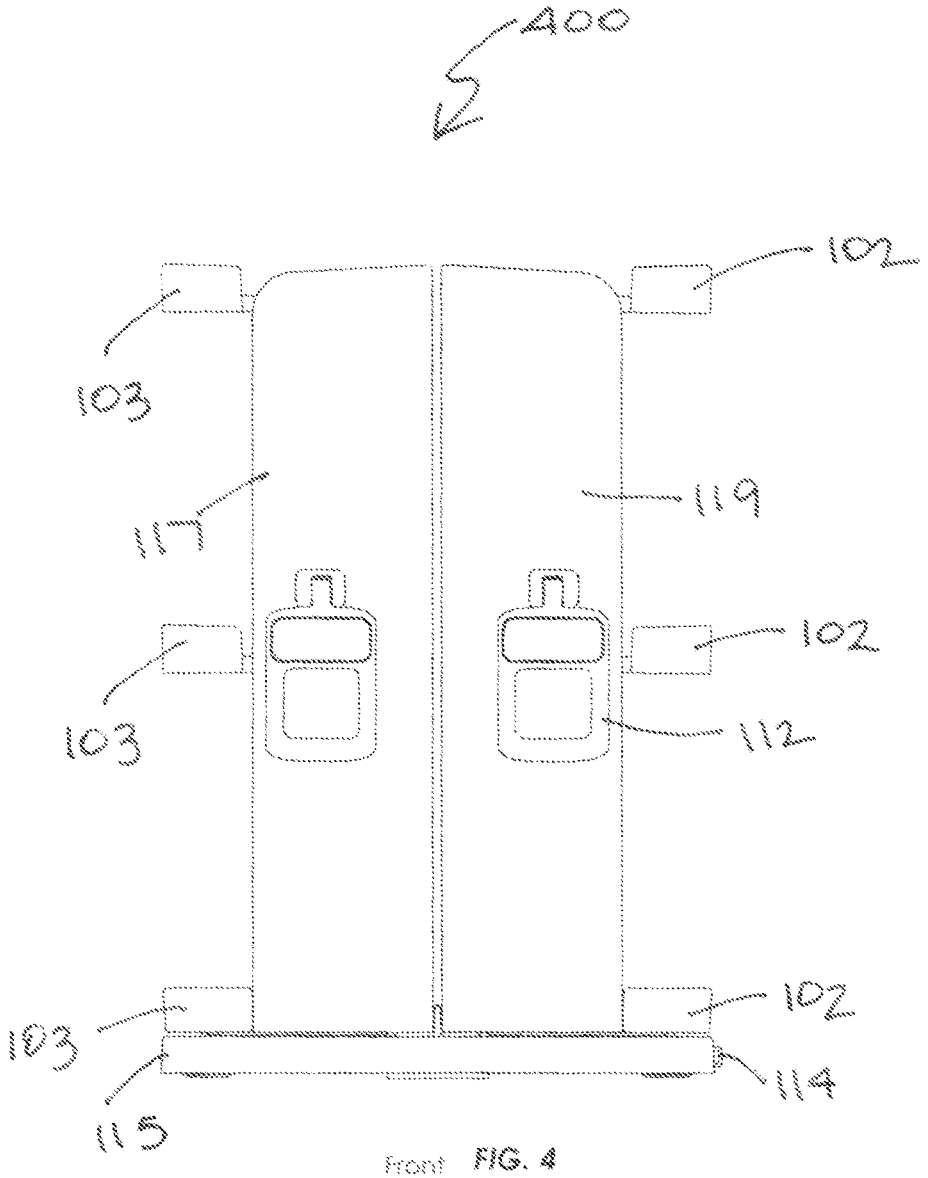
FIG. 4 is a depiction of a front view of a particular illustrative embodiment of the invention.

FIG. 4 is a depiction of a front view of a particular illustrative embodiment of the invention 400.

Figure 5:
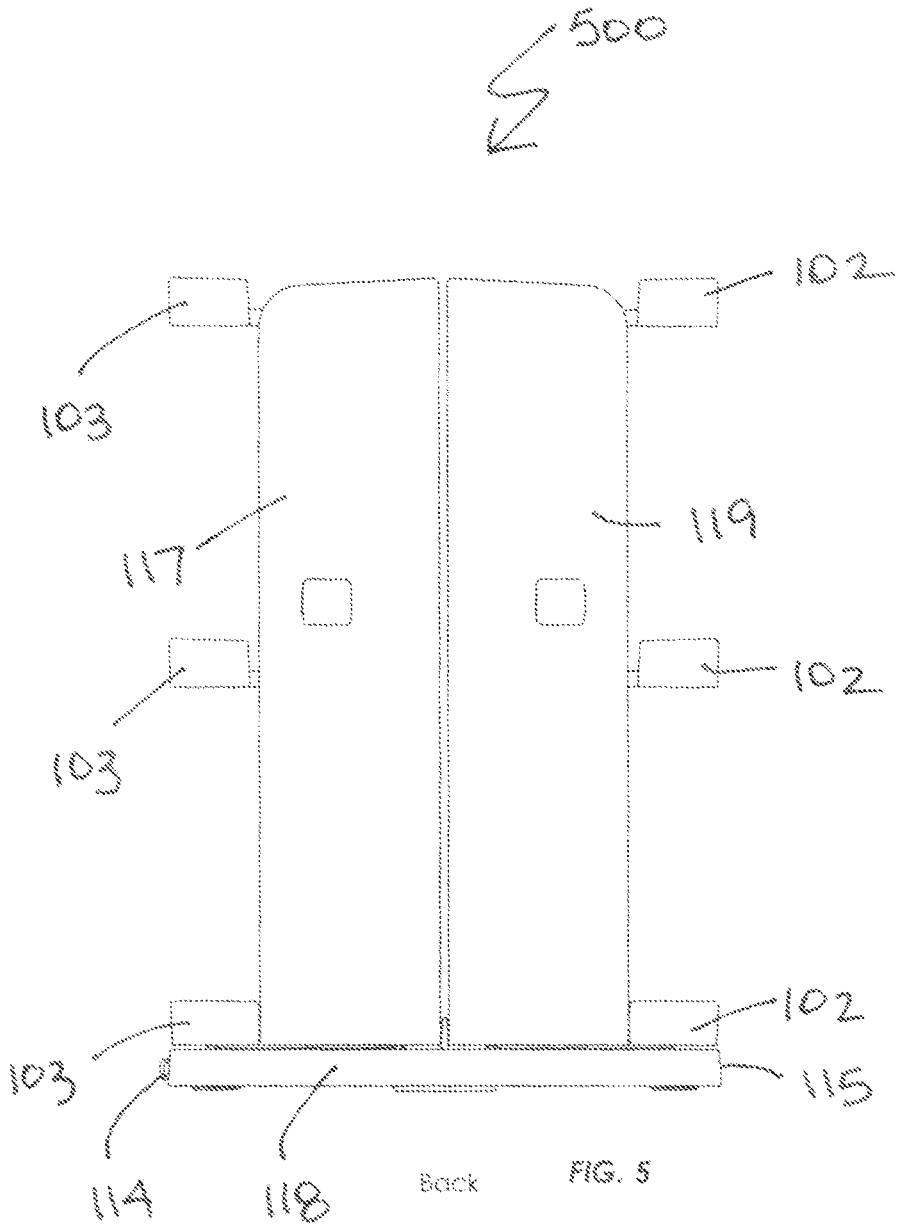
FIG. 5 is a depiction of a back view of a particular illustrative embodiment of the invention.

FIG. 5 is a depiction of a back view of a particular illustrative embodiment of the invention 500.

Figure 6:
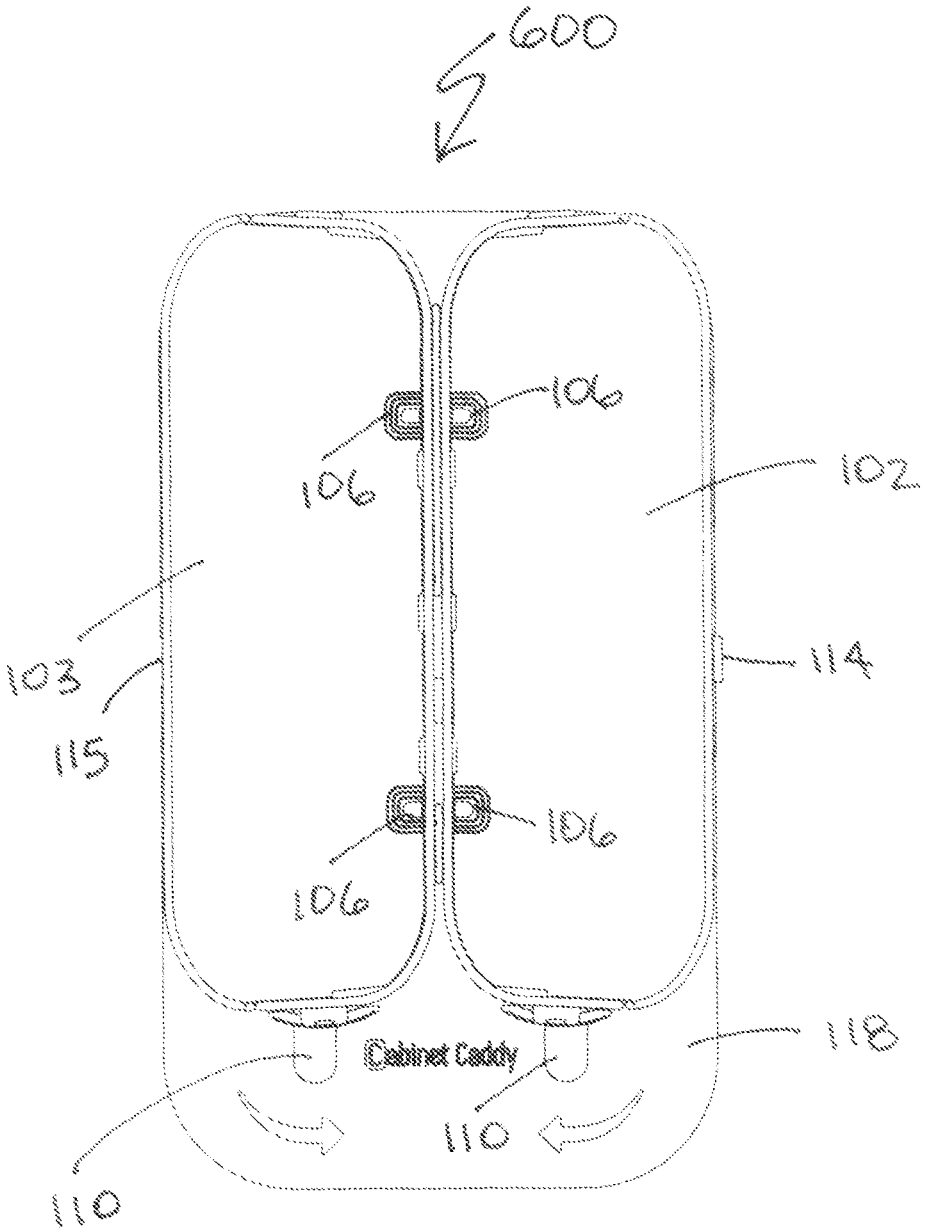
FIG. 6 is a depiction of a top view of a particular illustrative embodiment of the invention.

FIG. 6 is a depiction of a top view of a particular illustrative embodiment of the invention 600.

Figure 7:
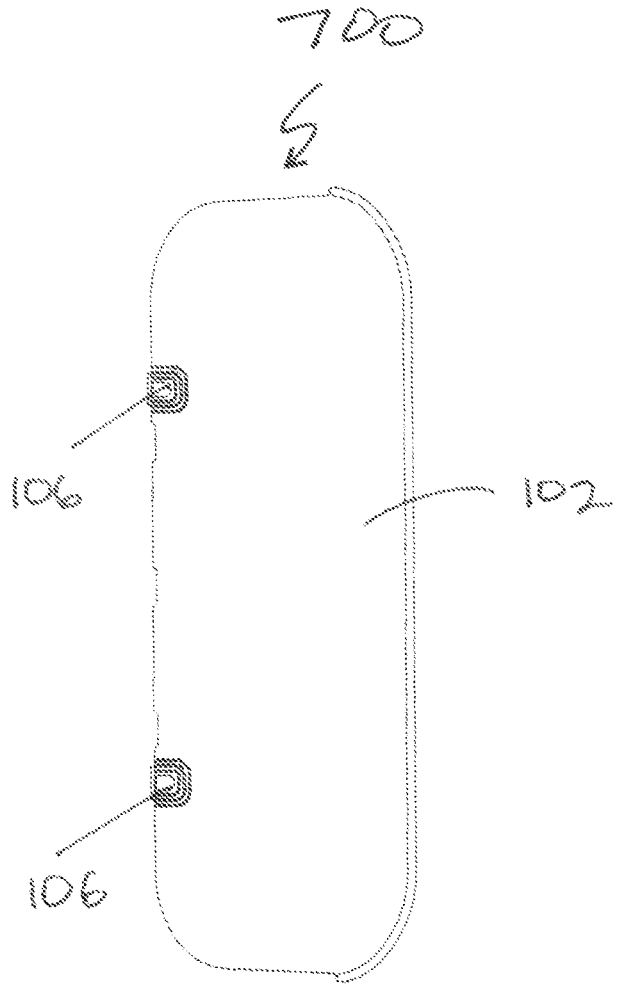
FIG. 7 is a depiction of a top view of a shelf in a particular illustrative embodiment of the invention.

FIG. 7 is a depiction of a top view of a shelf in a particular illustrative embodiment of the invention 700.

Figure 8:
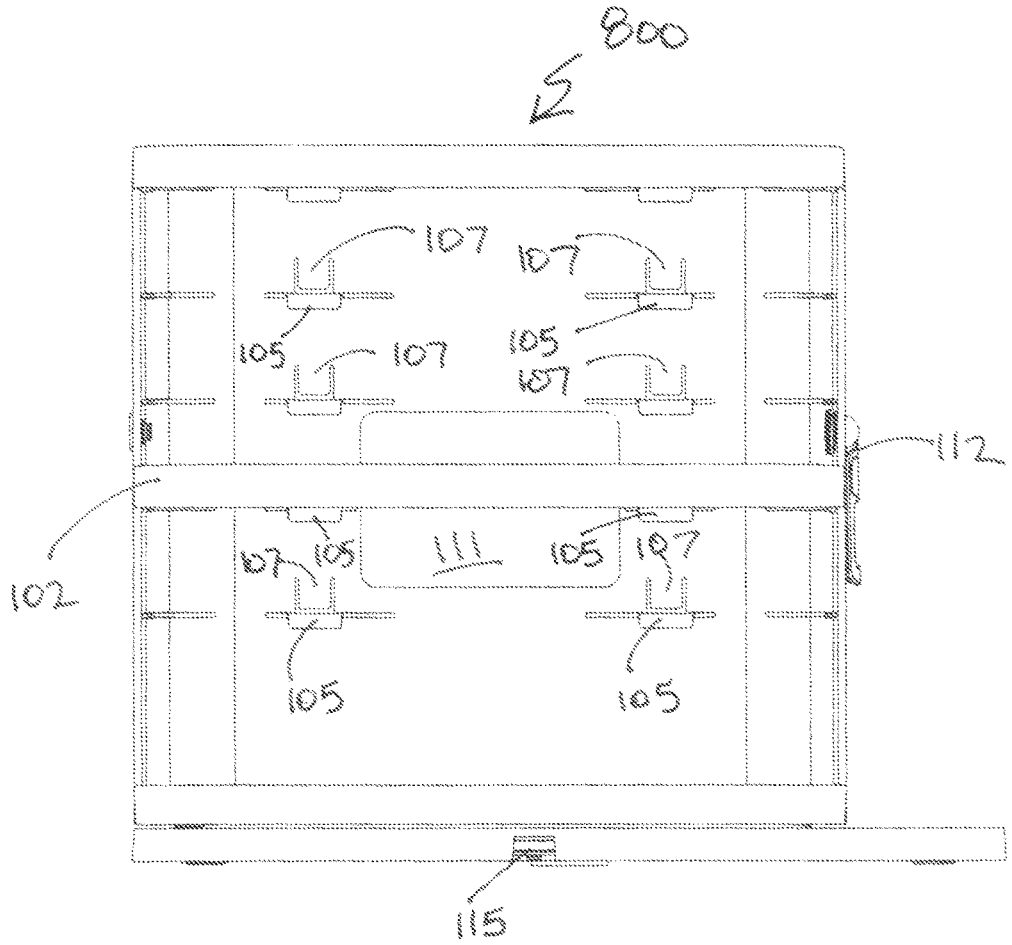
FIG. 8 is a depiction of a left side view of a particular illustrative embodiment of the invention.

FIG. 8 is a depiction of a left side view of a particular illustrative embodiment of the invention 800.

FIG. 9 is a depiction of a side view of a shelf in a particular illustrative embodiment of the invention 900.

Figure 10:
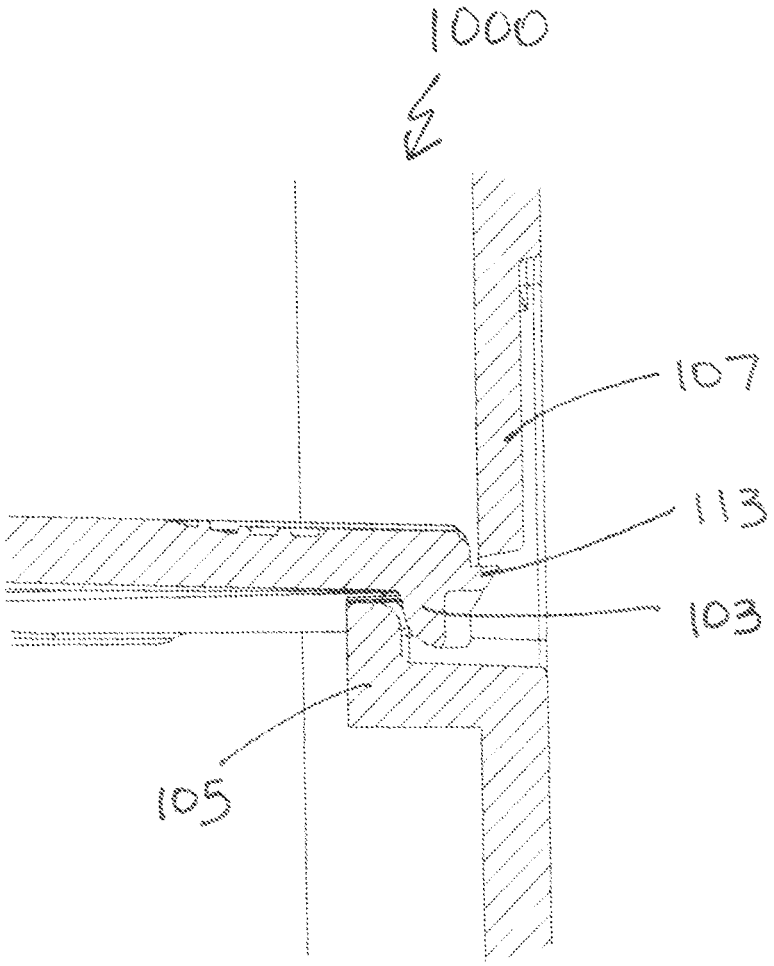
FIG. 10 is a depiction of a side view of a shelf snap engaged in a particular illustrative embodiment of the invention.

FIG. 10 is a depiction of a side view of a shelf snap engaged in a particular illustrative embodiment of the invention 1000.

Figure 11:
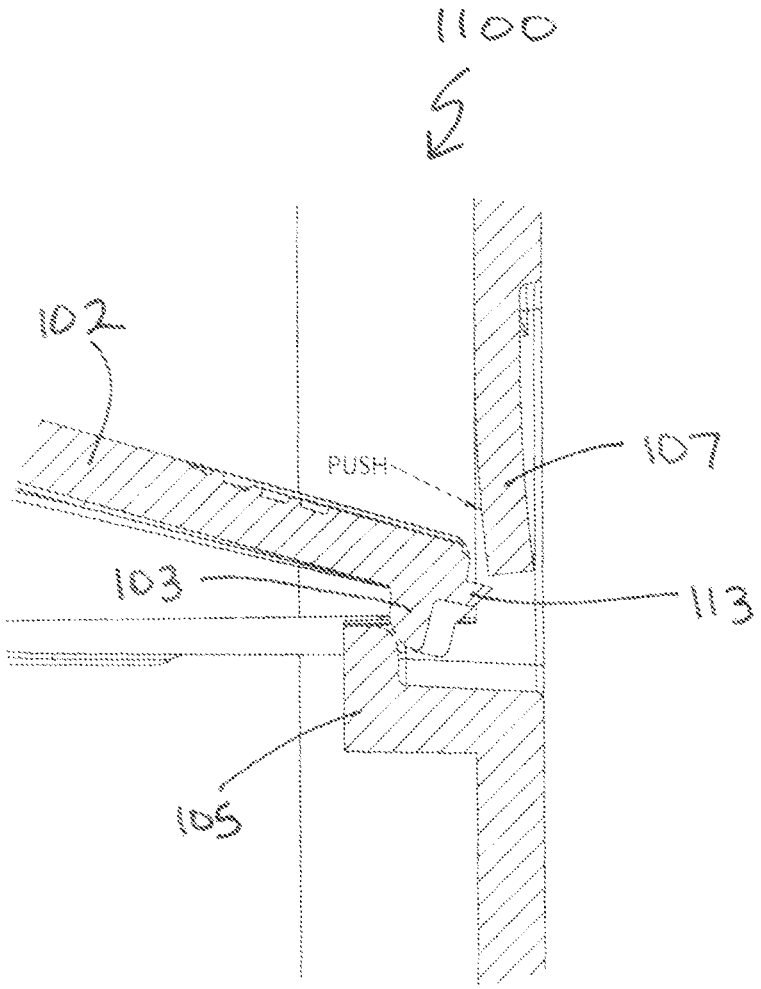
FIG. 11 is a depiction of a side view of a shelf snap showing engaging and in a particular illustrative embodiment of the invention.

FIG. 11 is a depiction of a side view of a shelf snap engaging and disengaging in a particular illustrative embodiment of the invention 1100.

Figure 12:
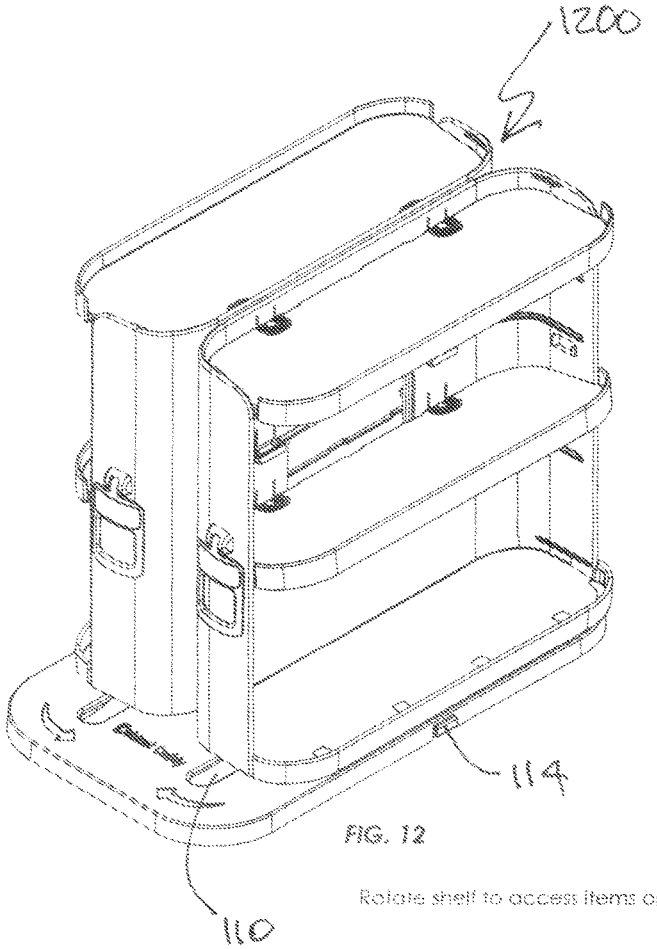
FIG. 12 is a depiction of three quarter prospective view of a particular illustrative embodiment of the invention.

FIG. 12 is a depiction of three quarter prospective view of a particular illustrative embodiment of the invention 1200.

Figure 13:
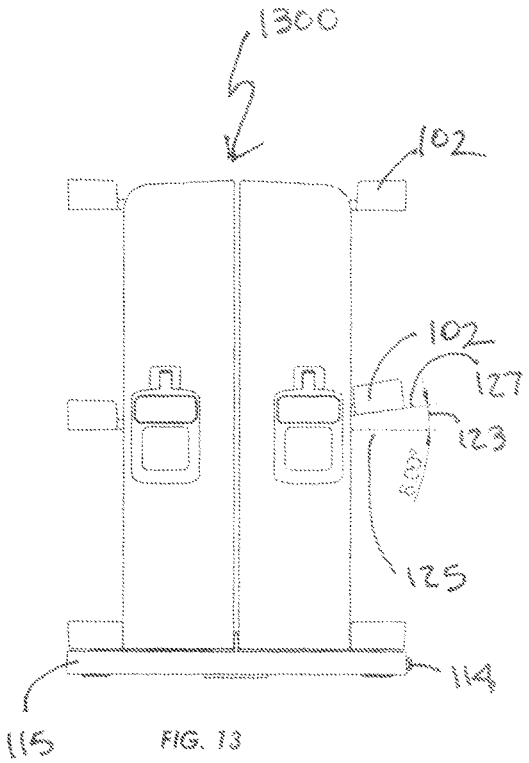
FIG. 13 is a depiction of a front view of a pivotable shelf in a particular illustrative embodiment of the invention.

FIG. 13 is a depiction of a front view of a pivotable shelf in a particular illustrative embodiment of the invention 1300. As shown in FIG. 13 the shelf can freely rotate vertically 8-15 degrees 123, 125, 127 at the distal edge of the shelf opposite the latched edge of the shelf, without releasing the shelf from the shelf latch. This makes it much easier to access and allows the shelves to be designed closer together. Also, the top surface on each of the installed trays is designed with a 3 degree tilt toward the back of the shelf that will help bias the bottle to the back of the shelf. This helps with stability.

Figure 14:
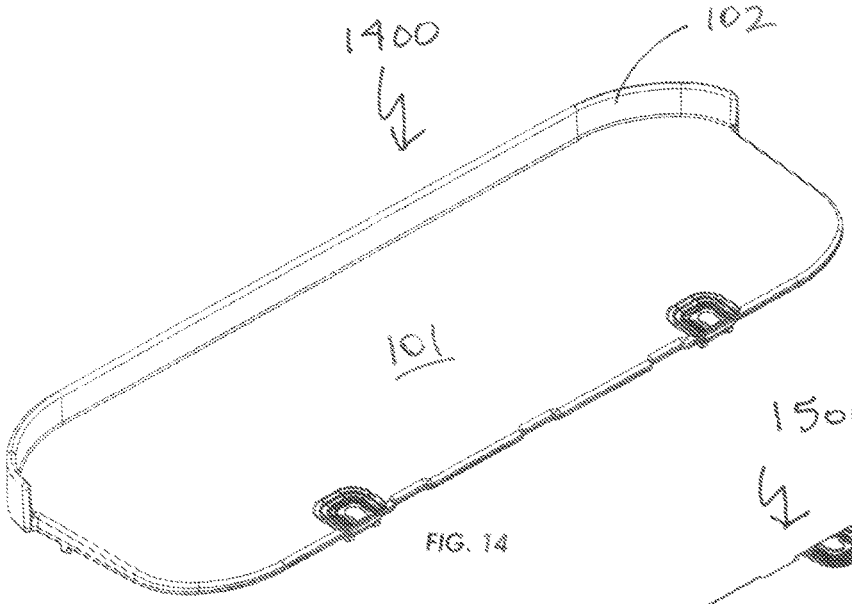
FIG. 14 is a depiction of three quarter prospective view of a shelf in a particular illustrative embodiment of the invention.
Figure 15:
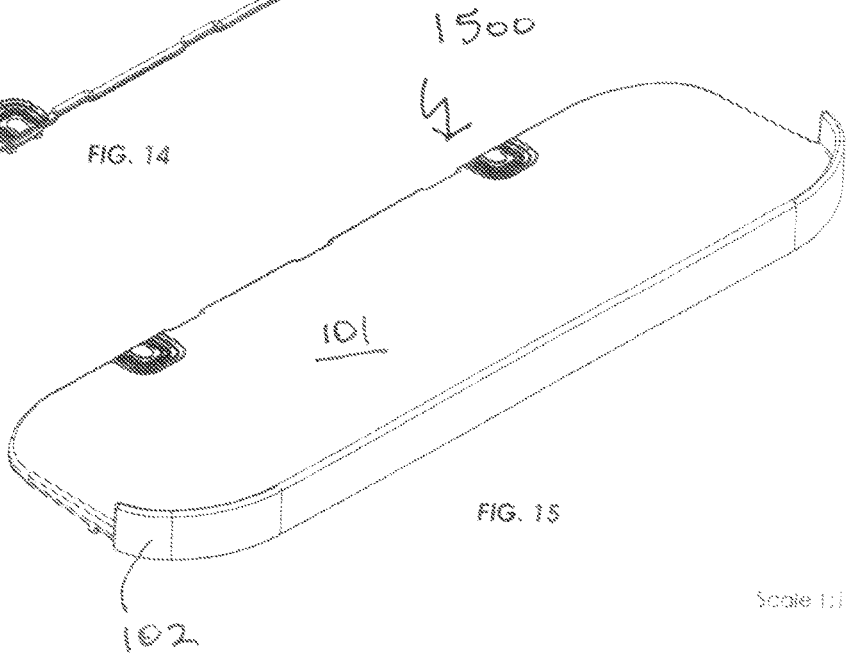
FIG. 15 is a depiction of three quarter prospective view of a shelf in a particular illustrative embodiment of the invention.

FIG. 14 is a depiction of three quarter prospective view of a shelf in a particular illustrative embodiment of the invention 1400. FIG. 15 is a depiction of three quarter prospective view of a shelf in a particular illustrative embodiment of the invention 1500. FIG. 16 shows an exploded prospective view of a particular illustrative embodiment of the invention 1600. In a particular illustrative embodiment of the invention right and left splines are guided by cam 204 which fixedly attached to pin 202 and rides in slot 110. Base 118 is supported on the cabinet floor by four high-friction feet 205. Guide slot 110 has front slot end 120 and rear slot end 121 which combined with cam 204 on pin 202 guide the travel of unit (1) from the stored position in FIG. 1 to the intermediate selected position in FIG. 17 1700.

Figure 17:
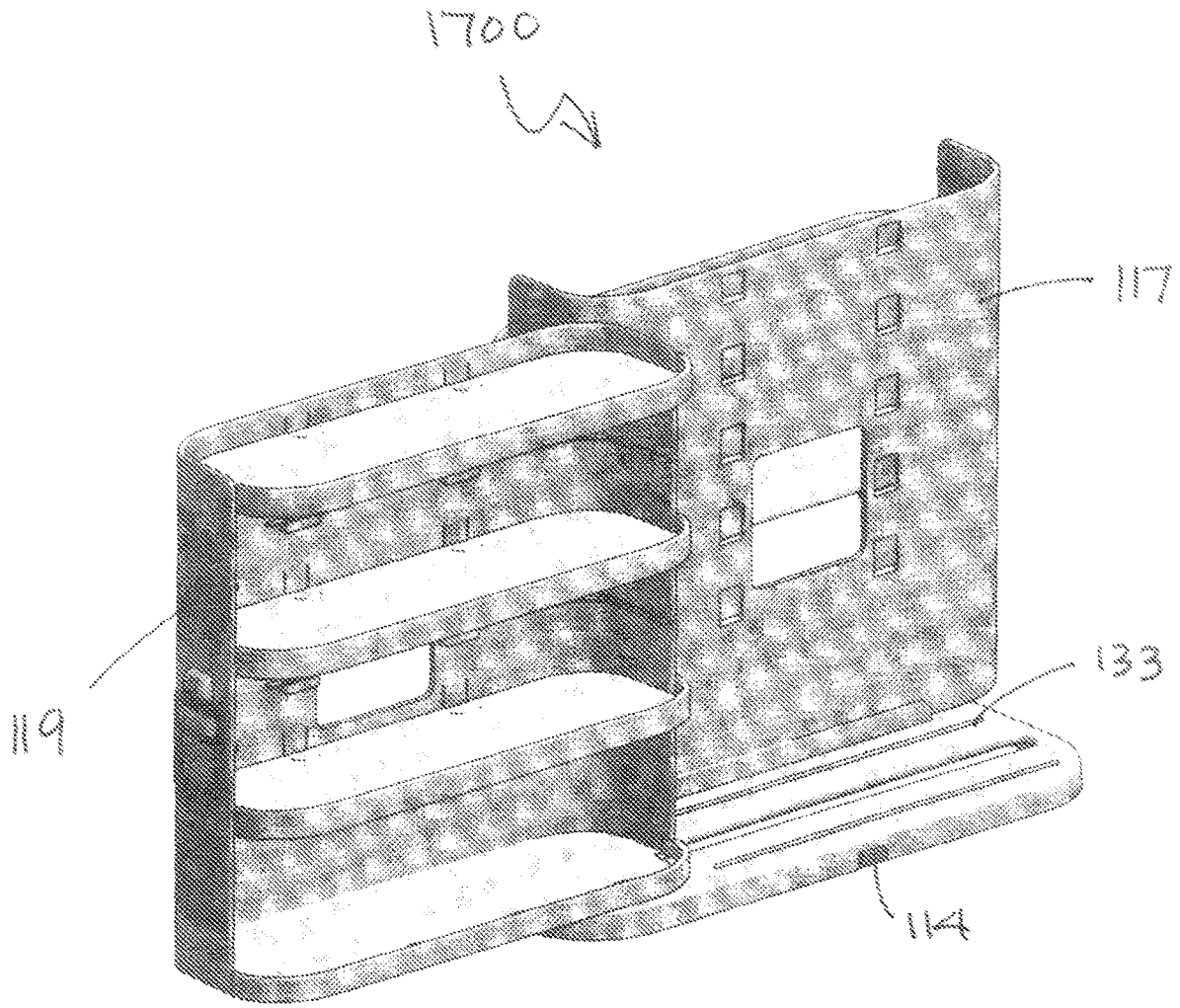
FIG. 17 is a depiction of three quarter prospective view of a particular illustrative embodiment of the invention in a second, slid forward position.

Turning now to FIG. 16, FIG. 16 shows an exploded perspective view 1600 of the modular storage unit connecting to the base. Turning now to FIG. 17, FIG. 17 shows a front perspective view 1700 of a modular book-like organizational storage unit in the intermittent pulled out position. Turning now to FIG. 18 and FIG. 19, FIGS. 18 and 19 show a front perspective view 1800 and 1900 of an index/pull handle for selecting and manually moving the modular organizational storage unit from its stored position to its intermittent position. Turning now to FIG. 20, FIG. 20 shows a front perspective view 2000 of a modular storage unit in its third, loading and retrieving position. Turning now to FIG. 21, FIG. 21 shows an exploded view 2100 of 3 modular storage units linked together with connectors, which in a particular illustrative embodiment of the invention are magnetic clips 114 and 115.

Figure 22:
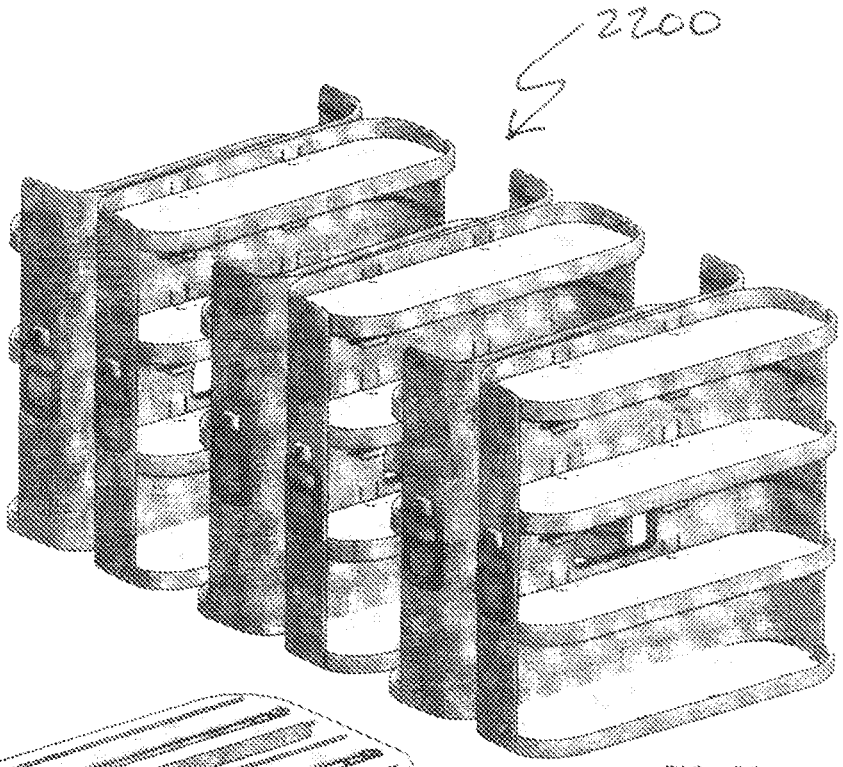
FIG. 22 is a depiction of three quarter prospective view of a particular illustrative embodiment of the invention wherein multiple storage rack systems are joined together.

FIG. 22 is a depiction of three quarter prospective view of a particular illustrative embodiment 2200 of the invention wherein multiple storage rack systems are joined together.

Figure 23:
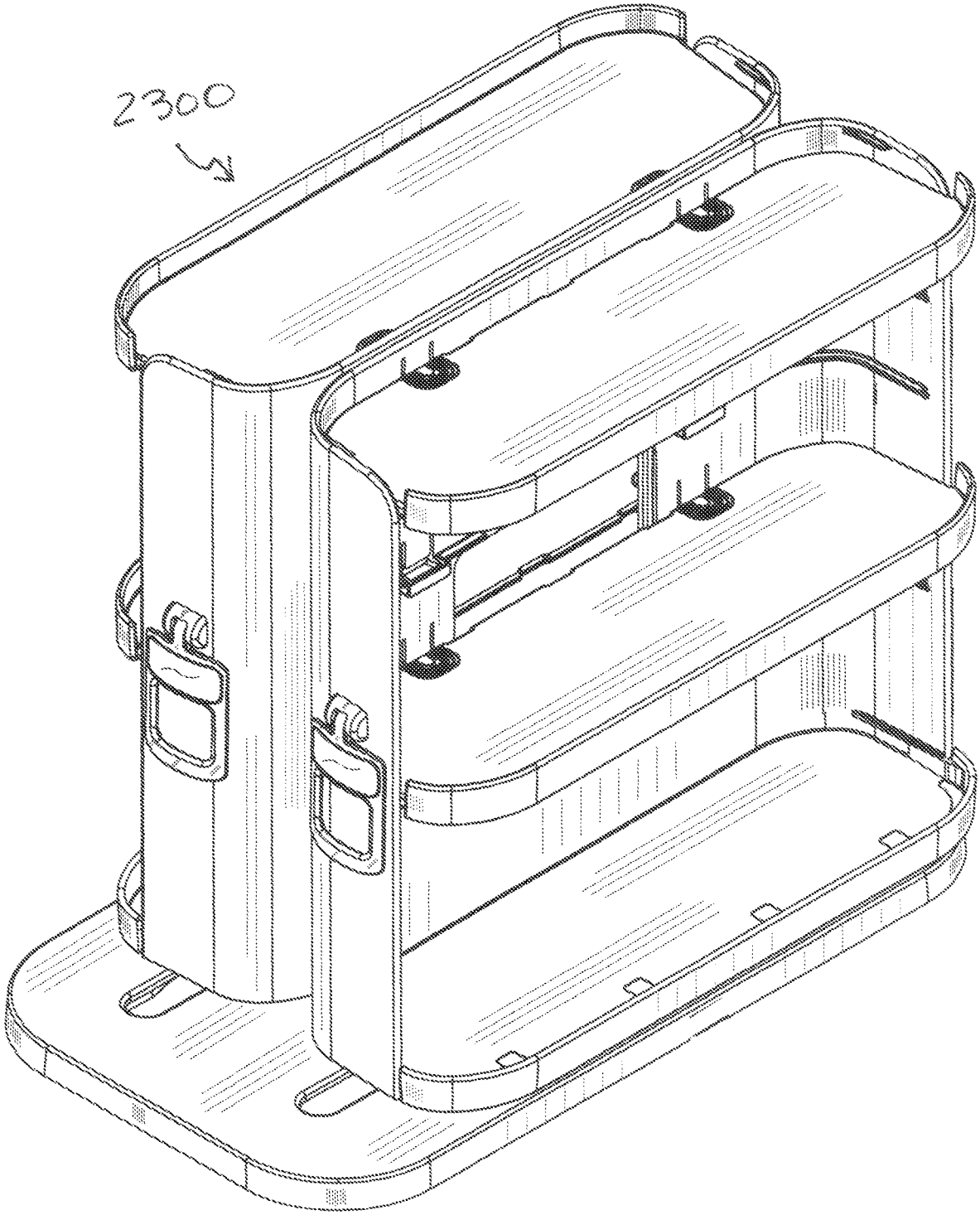
FIG. 23 is a depiction of three quarter isometric view of a particular illustrative embodiment of the invention showing an isometric view from a top right front corner.

FIG. 23 is a depiction of three quarter isometric view of a particular illustrative embodiment of the invention 2300 showing an isometric view from a top right front corner.

Figure 24:
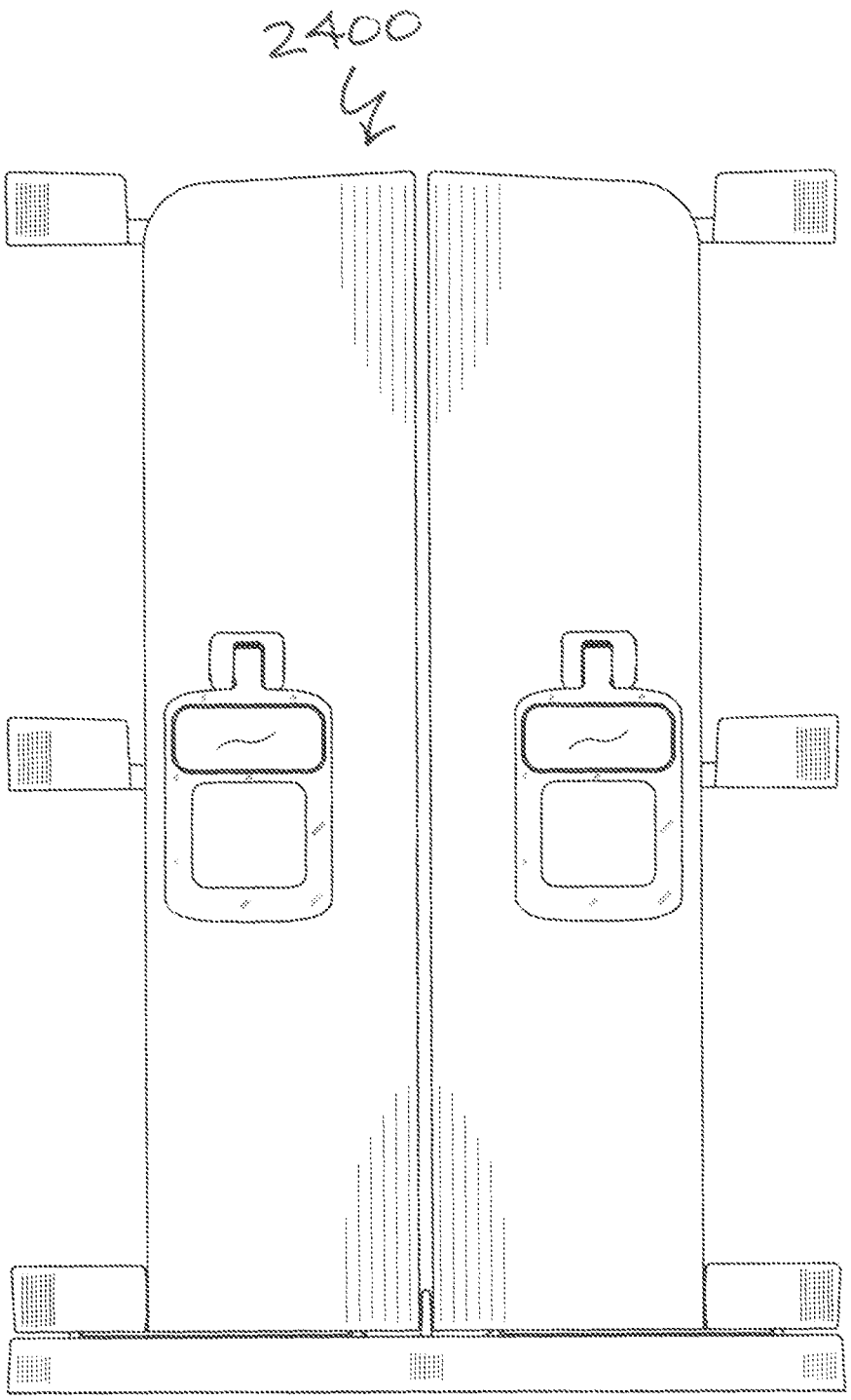
FIG. 24 is a depiction of front view of a particular illustrative embodiment of the invention.

FIG. 24 is a depiction of front view of a particular illustrative embodiment of the invention 2400.

Figure 25:
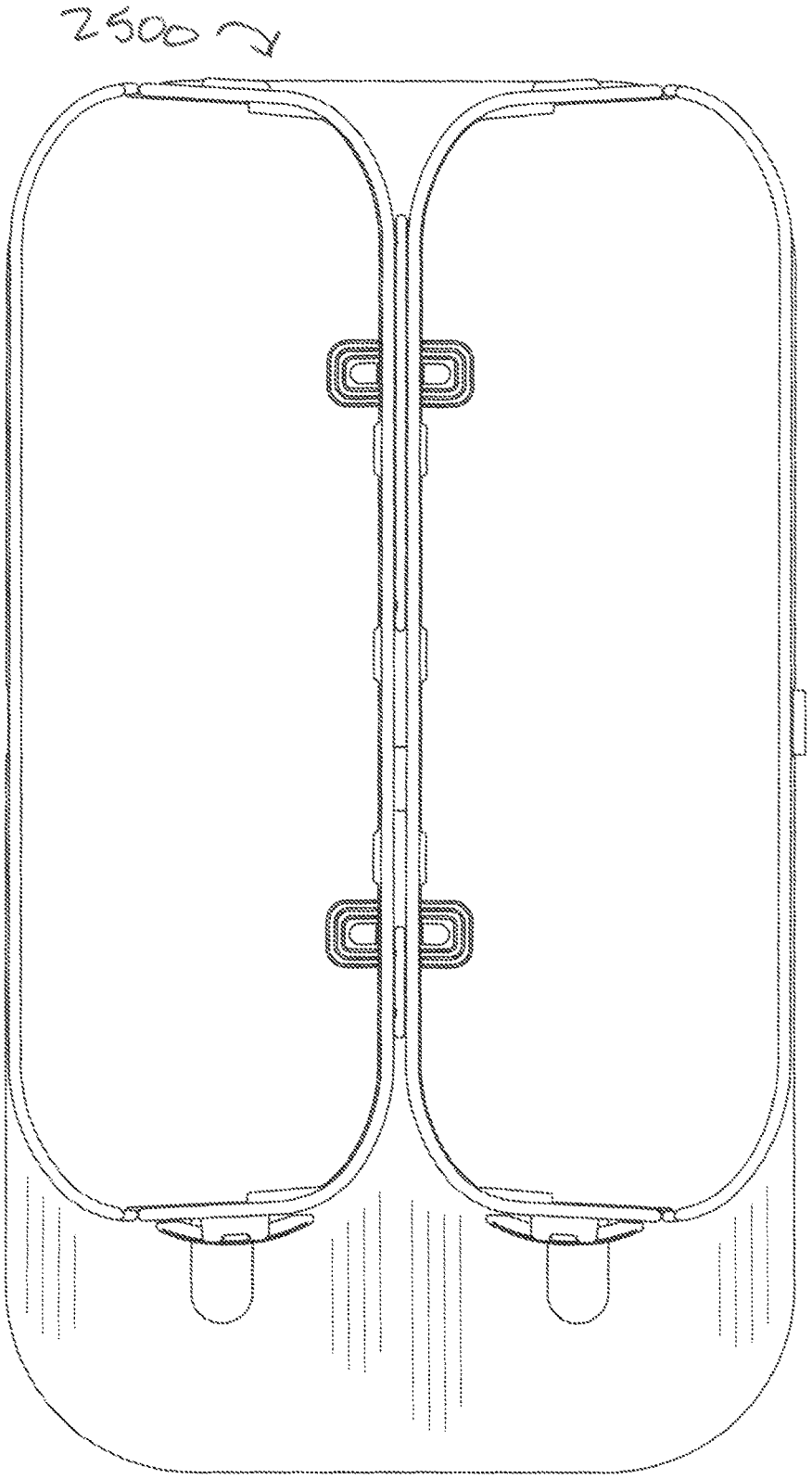
FIG. 25 is a depiction of a top view of a particular illustrative embodiment of the invention.

FIG. 25 is a depiction of a top view of a particular illustrative embodiment of the invention 2500.

Figure 26:
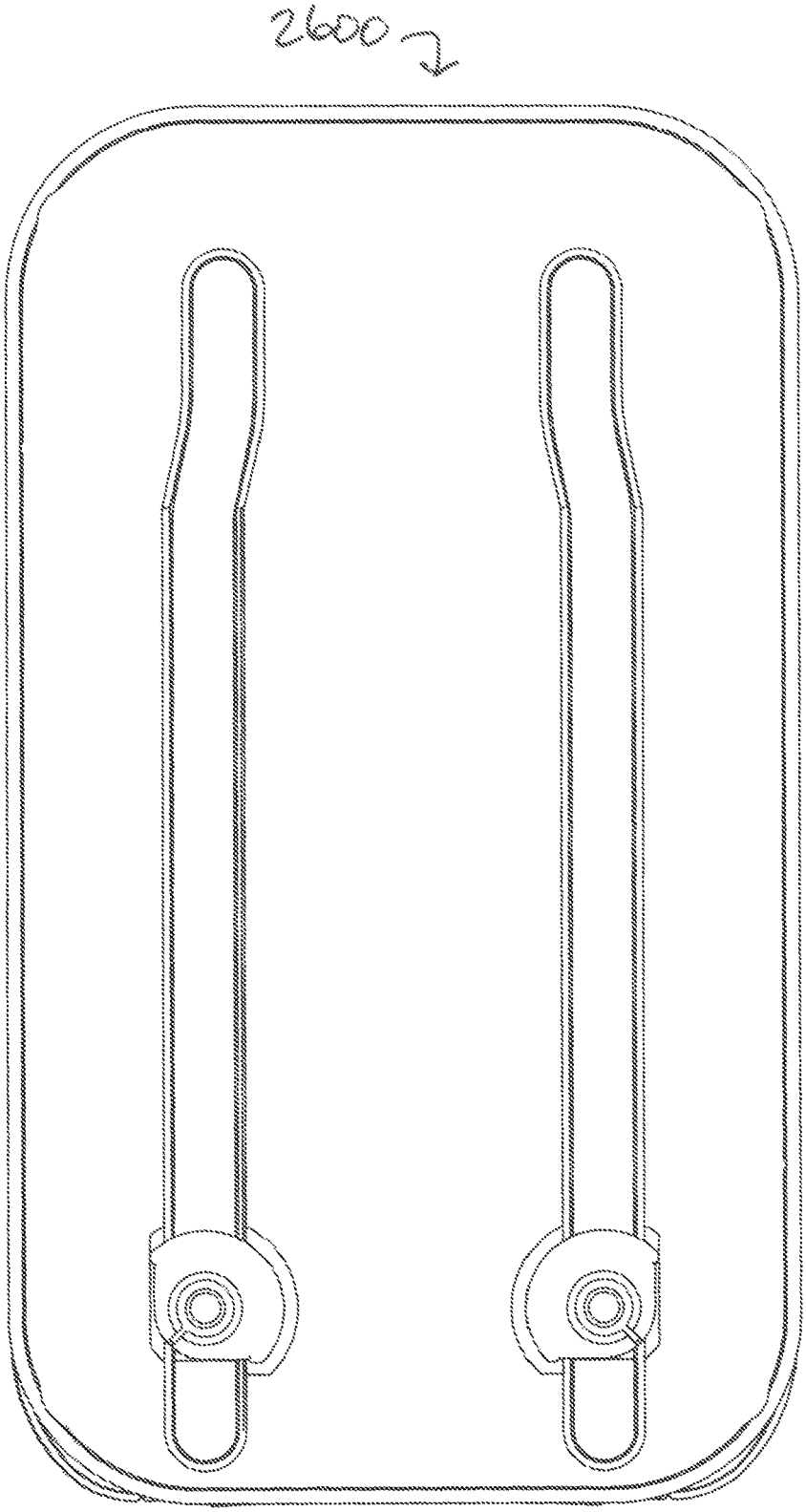
FIG. 26 is a depiction of a bottom view of a particular illustrative embodiment of the invention.

FIG. 26 is a depiction of a bottom view of a particular illustrative embodiment of the invention 2600.

Figure 27:
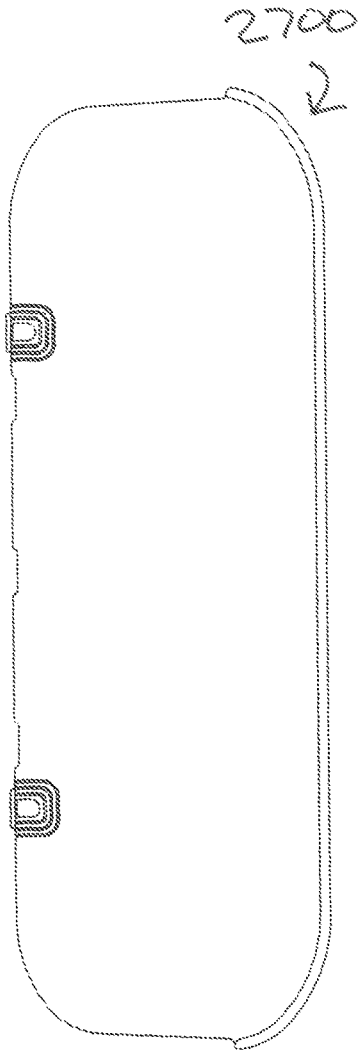
FIG. 27 is a depiction of a top view of a repositionable shelf in a particular illustrative embodiment of the invention.

FIG. 27 is a depiction of a top view of a particular illustrative embodiment of the invention 2700.

Figure 28:
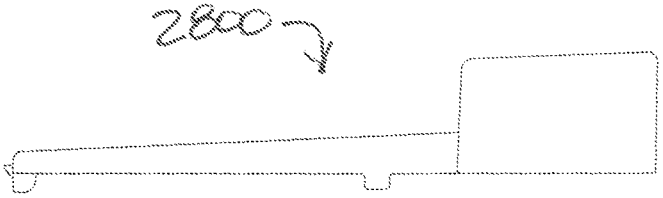
FIG. 28 is a depiction of a left-side view of a repositionable shelf in a particular illustrative embodiment of the invention.

FIG. 28 is a depiction of a left-side view of a particular illustrative embodiment of the invention 2800.

Figure 29:
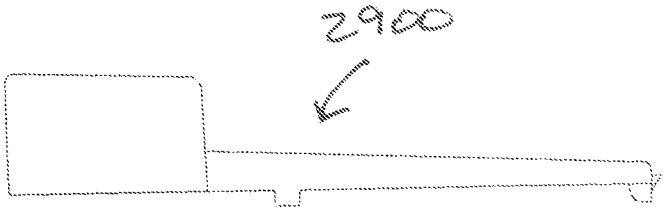
FIG. 29 is a depiction of a right-side view of a repositionable shelf in a particular illustrative embodiment of the invention.

FIG. 29 is a depiction of a right-side view of a particular illustrative embodiment of the invention 2900.

Figure 30:
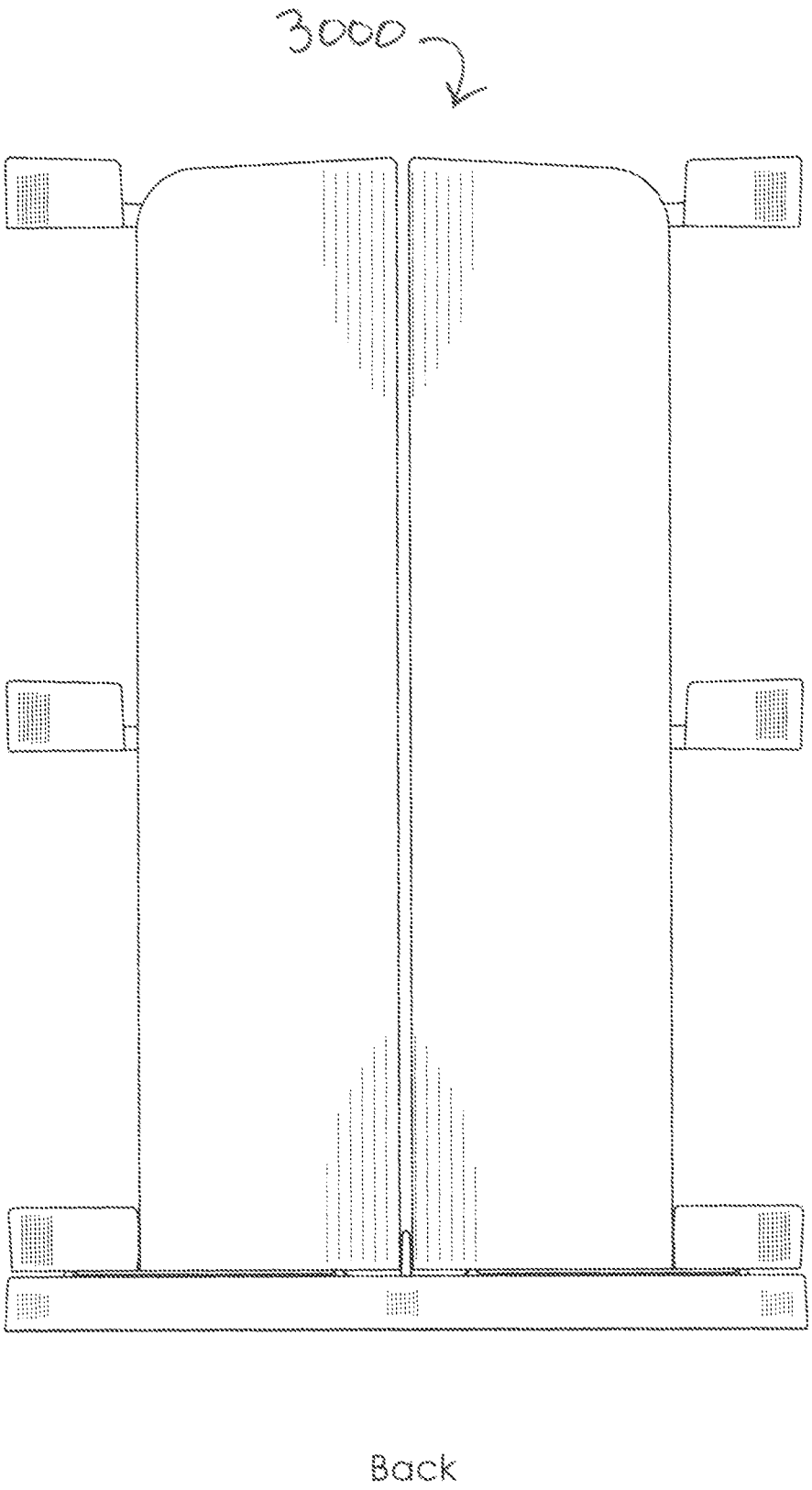
FIG. 30 is a depiction of a back view of a particular illustrative embodiment of the invention.

FIG. 30 is a depiction of a back view of a particular illustrative embodiment of the invention 3000.

Figure 31:
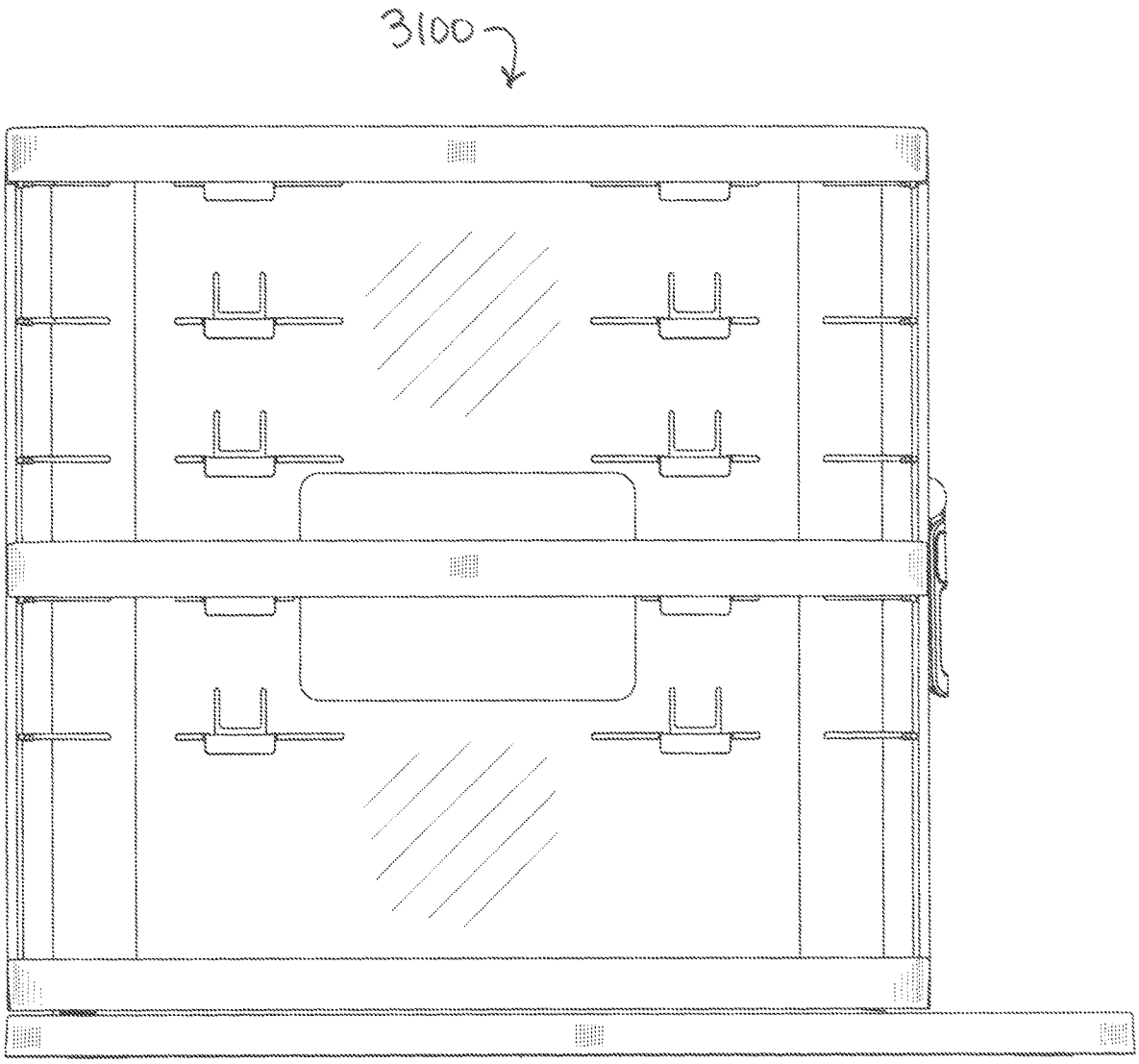
FIG. 31 is a depiction of a left-side view of a particular illustrative embodiment of the invention.

FIG. 31 is a depiction of a left-side view of a particular illustrative embodiment of the invention 3100.

Figure 32:
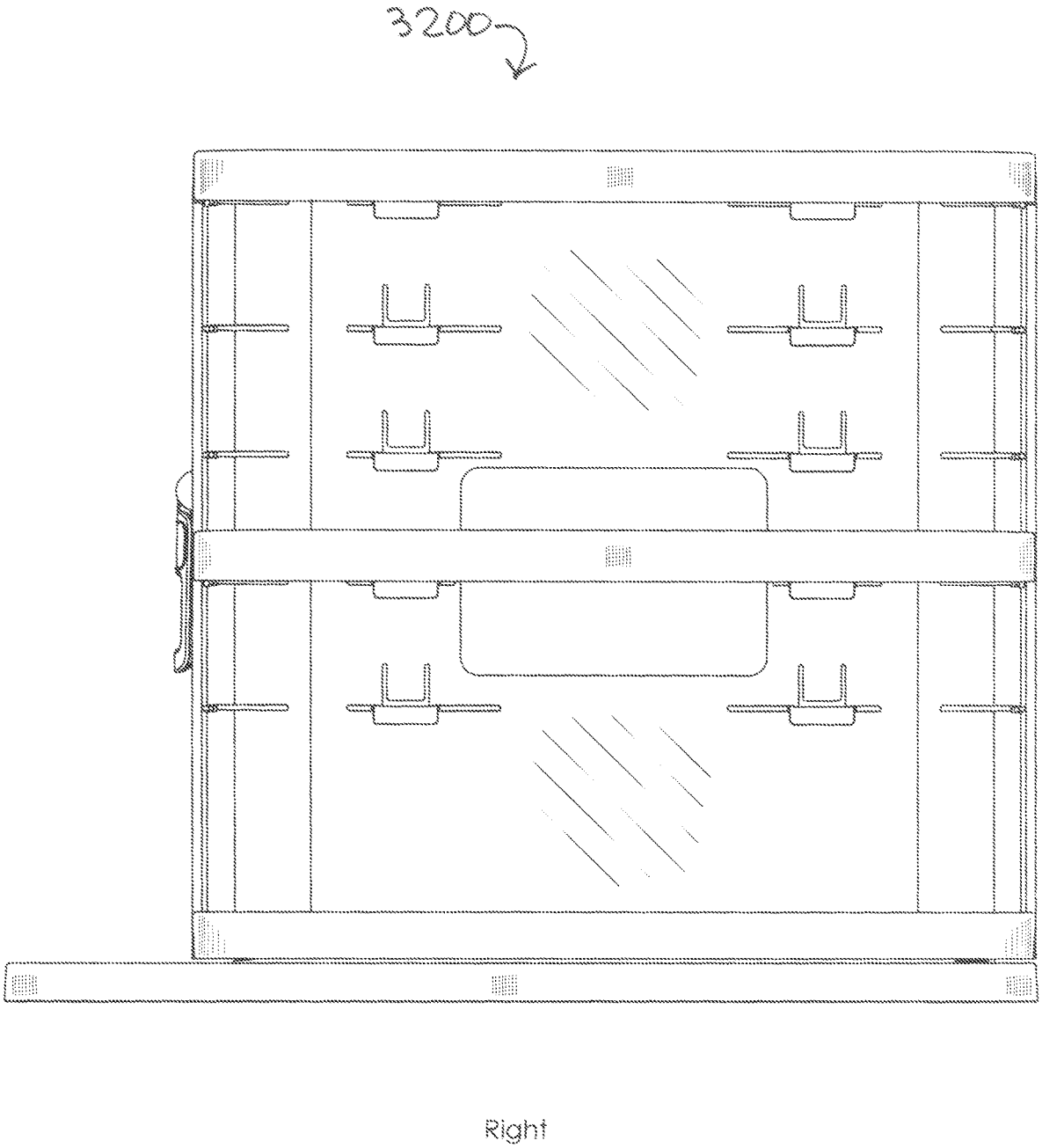
FIG. 32 is a depiction of a right-side view of a particular illustrative embodiment of the invention.

FIG. 32 is a depiction of a right-side view of a particular illustrative embodiment of the invention 3200.

From this home or latched position the floor of the shelf biases the shelf floor by 3 degrees above horizontal. This helps the stability of the bottles on the shelf. The shelf latch can freely rotate vertically 8-15 degrees without releasing the shelf latch. This makes it much easier to access and allows the shelves to be designed closer together. Also, the top surface on each of the installed shelves is designed with a 3 degree tilt toward the back of the shelf that will help bias the bottle to the back of the shelf. This will help with stability.

To unlatch and remove a shelf, empty, and sharply rotate the shelf upward about 30 degrees. The shelf will release, making the same loud snapping noise as when it was installed. The shelf snap is a positive and precision latch which is designed to withstand many life cycles with and rough handling without failing.

In another particular illustrative embodiment of the invention a storage apparatus is disclosed that provides for items densely packed, stored out of sight, and then presented for easy selection when needed. This disclosure describes a modular, horizontally expandable, book-like organizational system designed to efficiently fit inside a standard closed kitchen cabinet or to set openly on a bookshelf or table. Each individual unit has a curved book-like spine facing the front and rear giving the storage rack structural form and rigidity. The front spine houses a stick-on label indicating the storage contents and a drawer pull for manually controlling the in/out storage rack movement. Each individual storage module rests on its own base and multiple units can be added by interlocking additional bases together with a furnished U-shaped magnetic clip that magnetically attaches to an adjacent storage rack having a metallic plate to attach to the magnet of an adjacent storage rack. This makes it possible to fill a cabinet or bookshelf with multiple connected storage racks interconnected magnetically. Two or more interconnected storage rack are recommended to make a wide and stable unit. Each base contains a track designed to guide a cam assembly that is fixatedly attached to the bottom of the storage module. This cam/track design tethers the storage unit to its base while still allowing a selected storage unit to be pulled out of the horizontal stack and rotated 90 degrees to the open position. At this open position, the storage items are displayed, and the contents are readily accessible. There is a front-porch-like extension of the base that vertically supports the storage unit when it is in the selected position.

Special accessories with compartments, hooks and retaining brackets placed inside the storage module provide specialty storage for items such as tea bags, coffee pods and make up shelves. Shelves in the storage unit provide tiered storage. Another accessory provides false front book spines that can be snapped on the front storage rack spines disguising them to resemble a set of classical books, encyclopedias, or other book collections. The storage containers have full radius spines on the front and back of each storage unit. These full radius spines allow clearance for the selected storage unit to slide and rotate from its stored position to its open position without interfering with the adjacent storage modules on either side. When selecting a module, the unit does not have to be pulled straight all the way out and then sharply rotated 90 degrees to the stored position. Due to the design of the cam/track design and the generous radius on the front and rear spines, there is a degree of freedom in the rotation of the unit on its way to the open position. When finished accessing the selected storage unit, it can be moved back to its original stored position being guided by the cam in the base track.

A particular illustrative embodiment of the invention is disclosed as a storage system including but not limited to a base; a slot in the base; a spline that slides along the base; a plurality of latches in the spline; a plurality of shelves snapped into the plurality of latches; and a cam attached to a bottom of the spline, wherein the cam is slidably inserted into the slot in the base and guides spline along a path along the base. In another particular illustrative embodiment of the invention, the storage system of spline slides along the slot from a first stored position at a rear end of the slot, to a second intermediate at a front end of the slot and rotates at the front end of the slot. In another particular illustrative embodiment of the invention, the slot in the base has a first portion starting at a rear end of the slot that runs parallel to an outside edge of the base and a second portion that angle inward toward a center of the base, and a third portion that runs parallel to the outside edge of the base and closer to the center of the base, wherein the third portion of the slot ends at the front end of the slot, wherein the spline rotates in the front end of the slot toward the center of the base. In another particular illustrative embodiment of the invention, the front end of the slot provides an axis or rotation for the spline that is closer to the center of the base than the first portion of the slot.

In another particular illustrative embodiment of the invention, the system further includes but is not limited to a rib formed between the center of the base and an edge of the spline, wherein and inside edge of the spline closer to the center of the base contacts the rib and the rib limits rotation of the spline as the spline slide along the slot from a rear end of the slot to the second portion of the slot. In another particular illustrative embodiment of the invention, the ribs runs from the rear end of the slot to the second portion of the slot, wherein the cam further limits rotation of the spline as the spline slides along the second portion of the slot.

In another particular illustrative embodiment of the invention, a distal end away from the latch of a first one of the plurality of shelves rotates up and down 15 degrees without disengaging the first one of the plurality of shelves from the latch, to provide additional clearance between a second shelf below the first shelf, to enable placing and removing items from the second shelf. In another particular illustrative embodiment of the invention, at least one of the plurality of shelves is biased at a 3-degree angle upward and away from a first edge of the one of the plurality of shelves latched into the spline, to provide stability of the storage system when the one of the plurality of shelves is loaded with item, so that the items stored on the shelf tend to slide toward the first edge of the shelf.

In another particular illustrative embodiment of the invention, the storage system further includes a vertical ledge formed a distal end of the shelf away from the latch to keep items on the shelf. In another particular illustrative embodiment of the invention, the storage system further includes but is not limited to a second slot in the base; a second spline that slides along the second slot in the base; a plurality of latches in the second spline; a plurality of shelves snapped into the plurality of latches; and a second cam attached to a bottom of the second spline, wherein the second cam is slidably inserted into the second slot in the base and guides second spline along a second path along the base.

In another particular illustrative embodiment of the invention, the first spline slides along the first slot from the rear end of the first slot to the front end of the first slot while the second spline is in a stored position at the rear end of the second slot. In another particular illustrative embodiment of the invention, the storage system further includes but is not limited to a second base, having a third and fourth spline sliding along a third and fourth slot; and a connector on a side of the first and second base for fixing the first and second base adjacent each other. In another particular illustrative embodiment of the invention, the connector is a magnet. In another particular illustrative embodiment of the invention, the shelf is removed from the latch by rotating the distal end of the shelf in the latch by 30 degrees.

Each of the appended claims defines a separate invention which, for infringement purposes, is recognized as including equivalents of the various elements or limitations specified in the claims. Depending on the context, all references below to the "invention" may in some cases refer to certain specific embodiments only. In other cases, it will be recognized that references to the "invention" will refer to the subject matter recited in one or more, but not necessarily all, of the claims. Each of the inventions will now be described in greater detail below, including specific embodiments, versions, and examples, but the inventions are not limited to these specific embodiments, versions, or examples, which are included to enable a person having ordinary skill in the art to make and use the inventions when the information in this patent is combined with available information and technology. Various terms as used herein are defined below, and the definitions should be adopted when construing the claims that include those terms, except to the extent a different meaning is given within the specification or in express representations to the Patent and Trademark Office (PTO). To the extent a term used in a claim is not defined below or in representations to the PTO, it should be given the broadest definition persons having skill in the art have given that term as reflected in at least one printed publication, dictionary, or issued patent.

Certain specific embodiments of methods, structures, elements, and parts are described below, which are by no means an exclusive description of the inventions. Other specific embodiments, including those referenced in the drawings, are encompassed by this application and any patent that issues therefrom.

The invention claimed is:

1. A storage system, the system comprising:

a base;

a slot in the base;

a spline that is configured to slide along the base;

a plurality of latches in the spline;

a plurality of shelves snapped into the plurality of latches; and a cam attached to a bottom of the spline, wherein the cam is slidably inserted into the slot in the base and is configured to guide the spline along a path along the base;

wherein the spline is configured to slide along the slot from a first stored position at a rear end of the slot, to a second intermediate position at a front end of the slot and the spline is configured to rotate at the front end of the slot, wherein the slot in the base has a first portion starting at the rear end of the slot that runs parallel to an outside edge of the base and a second portion that is angled inward toward a center of the base, and a third portion that runs parallel to the outside edge of the base and is closer to the center of the base than the first position of the slot, wherein the third portion of the slot ends at the front end of the slot, wherein the spline is configured to rotate at the front end of the slot toward the center of the base.

2. The storage system of claim 1, wherein the front end of the slot provides an axis of rotation for the spline that is closer to the center of the base than the first portion of the slot.

3. The system of claim 1, further comprising:

a rib formed between the center of the base and an inside edge of the spline, wherein the inside edge of the spline is closer to the center of the base than an outside edge of the spline, wherein the inside edge of the spline is configured to contact the rib and the rib is configured to limit rotation of the spline as the spline slide along the slot from a rear end of the slot to the second portion of the slot.

4. The system of claim 3, wherein the ribs runs from the rear end of the slot to the second portion of the slot, wherein the cam further limits rotation of the spline as the spline slides along the second portion of the slot.

5. The system of claim 3, wherein a distal end away from the latches of a first shelf of the plurality of shelves is configured to rotate up and down 15 degrees without disengaging the first shelf of the plurality of shelves from a corresponding first pair of latches from the plurality of latches, to provide additional clearance between a second shelf of the plurality of shelves below the first shelf, to enable placing and removing items from the second shelf.

6. The system of claim 3, wherein at least one of the plurality of shelves is biased at a 3-degree angle upward and away from a first edge of the one of the plurality of shelves that is latched into the spline, to provide stability of the storage system when the at least one of the plurality of shelves is loaded with items, so that the items stored on the at least one of the plurality of shelves to slide toward the first edge of the at least one of the plurality of shelves.

7. The system of claim 6, further comprising:

a vertical ledge that extends upward from a distal end of the shelf away from the latch to keep items on the shelf.

8. The system of claim 7, further comprising:

a second slot in the base;

a second spline that is configured to slide along the second slot in the base;

a plurality of second latches in the second spline;

a plurality of second shelves snapped into the plurality of second latches; and a second cam attached to a bottom of the second spline, wherein the second cam is slidably inserted into the second slot in the base and the second cam is configured to guide the second spline along a second path along the base.

9. The system of claim 8, wherein the first spline is configured to slide along the first slot from the rear end of the first slot to the front end of the first slot while the second spline is in a stored position at the rear end of the second slot.

10. The system of claim 9, further comprising:

a second base having third and fourth slot, wherein a third and fourth spline is configured to slide along the third and fourth slot respectively; and a connector on a side of the first and second base respectively for fixing the first and second base adjacent each other.

11. The system of claim 10, wherein the connector is a magnet.

12. The system of claim 5, wherein the first shelf is configured to be removed from the corresponding first pair of latches by rotating the distal end of the first shelf in the corresponding pair of latches by 30 degrees.

* * * * *